US009635903B2

(12) United States Patent
Lawless

(10) Patent No.: US 9,635,903 B2
(45) Date of Patent: May 2, 2017

(54) SOLE STRUCTURE HAVING AUXETIC STRUCTURES AND SIPES

(71) Applicant: NIKE, Inc., Beaverton, OR (US)

(72) Inventor: Deborah L. Lawless, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 33 days.

(21) Appl. No.: 14/826,901

(22) Filed: Aug. 14, 2015

(65) Prior Publication Data

US 2017/0042284 A1 Feb. 16, 2017

(51) Int. Cl.

| | |
|---|---|
| ***A43B 13/18*** | (2006.01) |
| ***A43B 3/00*** | (2006.01) |
| ***A43B 13/12*** | (2006.01) |
| ***A43B 13/14*** | (2006.01) |
| ***A43B 1/00*** | (2006.01) |

(52) U.S. Cl.

CPC ..... *A43B 13/181* (2013.01); *A43B 1/0009* (2013.01); *A43B 3/0073* (2013.01); *A43B 13/122* (2013.01); *A43B 13/141* (2013.01)

(58) Field of Classification Search

CPC ... A43B 13/181; A43B 13/122; A43B 13/141; A43B 1/0009; A43B 3/0073

See application file for complete search history.

(56) References Cited

U.S. PATENT DOCUMENTS

| | | | |
|---|---|---|---|
| 503,062 | A | 8/1893 | Norwood |
| 1,343,450 | A | 6/1920 | Haskell |
| 1,733,733 | A | 10/1929 | Hess |
| 2,211,509 | A | 8/1940 | Lumbard |
| 2,251,468 | A | 8/1941 | Smith |
| 2,363,995 | A | 11/1944 | Rollman et al. |
| 2,432,533 | A | 12/1947 | Margolin |
| 2,963,722 | A | 12/1960 | Stix |
| 3,626,532 | A | 12/1971 | Smith |
| 3,662,478 | A | 5/1972 | Schwab |
| 3,745,600 | A | 7/1973 | Rubico et al. |
| 3,757,436 | A | 9/1973 | Winkler et al. |
| 4,050,108 | A | 9/1977 | Londner |
| 4,272,850 | A | 6/1981 | Rule |
| 4,340,626 | A | 7/1982 | Rudy |
| 4,484,398 | A | 11/1984 | Goodwin et al. |
| 4,668,557 | A | 5/1987 | Lakes |

(Continued)

FOREIGN PATENT DOCUMENTS

| | | | |
|---|---|---|---|
| GB | 2 147 792 | A | 5/1985 |
| GB | 2 455 167 | A | 6/2009 |

(Continued)

OTHER PUBLICATIONS

International Search Report and Written Opinion mailed Dec. 4, 2014 in PCT/US2014/052038.

(Continued)

*Primary Examiner* — Ted Kavanaugh

(74) *Attorney, Agent, or Firm* — Quinn Law Group, PLLC

(57) ABSTRACT

A sole structure that includes recessed portions. The recessed portions are arranged such that the sole structure has auxetic properties. In some embodiments, sipes extend to the recessed portions. Additionally, the sole structure may include a central portion having auxetic properties and a peripheral portion.

21 Claims, 16 Drawing Sheets

(56) References Cited

U.S. PATENT DOCUMENTS 4,756,098 A 7/1988 Boggia
4,858,340 A 8/1989 Pasternak
4,899,412 A 2/1990 Ganon
4,967,492 A 11/1990 Rosen
4,999,931 A 3/1991 Vermeulen
5,012,597 A 5/1991 Thomasson
5,060,402 A 10/1991 Rosen
D339,459 S 9/1993 Yoshikawa et al.
D344,170 S 2/1994 Acoff
5,469,639 A 11/1995 Sessa
5,718,064 A 2/1998 Pyle
5,813,146 A 9/1998 Gutkowski et al.
5,918,338 A 7/1999 Wong
D413,714 S 9/1999 Challant
D420,786 S 2/2000 Ramer et al.
6,151,804 A 11/2000 Hieblinger
6,178,662 B1 1/2001 Legatzke
D437,106 S 2/2001 Cagner
6,226,896 B1 5/2001 Friton
D453,989 S 3/2002 Cagner
6,357,146 B1 3/2002 Wordsworth et al.
6,412,593 B1 7/2002 Jones
6,487,795 B1 12/2002 Ellis, III
6,564,476 B1 5/2003 Hernandez
6,574,889 B2 6/2003 Cagner
D487,614 S 3/2004 Le
D488,916 S 4/2004 McClaskie
6,862,820 B2 3/2005 Farys et al.
D531,788 S 11/2006 Rittberg
7,132,032 B2 11/2006 Tawney et al.
7,160,621 B2 1/2007 Chaudhari et al.
7,252,870 B2 8/2007 Anderson et al.
7,254,906 B2 8/2007 Morris et al.
7,287,343 B2 10/2007 Healy
7,310,894 B1 12/2007 Schwarzman et al.
D571,543 S 6/2008 Sungadi
7,455,567 B2 11/2008 Bentham et al.
7,487,602 B2 2/2009 Berger et al.
7,546,698 B2 6/2009 Meschter
7,574,818 B2 8/2009 Meschter
D614,382 S 4/2010 Grenet et al.
7,770,307 B2 8/2010 Meschter
7,814,852 B2 10/2010 Meschter
7,827,703 B2 11/2010 Geer et al.
7,870,681 B2 1/2011 Meschter
7,870,682 B2 1/2011 Meschter et al.
8,002,879 B2 8/2011 Hook
D653,844 S 2/2012 Smith
8,122,616 B2 2/2012 Meschter et al.
8,132,340 B2 3/2012 Meschter
8,186,078 B2 5/2012 Avar et al.
8,196,316 B2 6/2012 Cook et al.
8,220,072 B2 7/2012 Dodd
8,225,530 B2 7/2012 Sokolowski et al.
8,266,827 B2 9/2012 Dojan et al.
8,276,294 B2 10/2012 Polegato Moretti
8,277,719 B2 10/2012 Alderson et al.
8,312,645 B2 11/2012 Dojan et al.
8,322,050 B2 12/2012 Lubart
8,333,021 B2 * 12/2012 Johnson ..... A43B 3/14 36/11
8,343,404 B2 1/2013 Meli et al.
8,388,791 B2 3/2013 Dojan et al.
8,490,299 B2 7/2013 Dua et al.
8,516,723 B2 8/2013 Ferrigan et al.
8,544,197 B2 10/2013 Spanks et al.
8,631,589 B2 1/2014 Dojan
8,661,564 B2 3/2014 Dodd
8,732,982 B2 5/2014 Sullivan et al.
D707,934 S 7/2014 Petrie
D716,027 S 10/2014 Kirschner
D717,034 S 11/2014 Bramani
8,961,733 B2 2/2015 Dodd
2004/0181972 A1 9/2004 Csorba
2006/0059717 A1 3/2006 Mitchell
2007/0213838 A1 9/2007 Hengelmolen
2007/0240333 A1 10/2007 Le et al.
2008/0011021 A1 1/2008 Starbuck et al.
2008/0216357 A1 9/2008 Fogg et al.
2008/0250673 A1 10/2008 Andrews et al.
2008/0289214 A1 11/2008 Aveni
2009/0064536 A1 3/2009 Klassen et al.
2009/0064540 A1 3/2009 Sokolowski et al.
2009/0119820 A1 5/2009 Bentham et al.
2009/0183392 A1 * 7/2009 Shane ..... A43B 1/0027 36/97
2009/0276933 A1 11/2009 Dodd
2009/0307932 A1 12/2009 Kirby et al.
2010/0029796 A1 2/2010 Alderson et al.
2010/0043255 A1 2/2010 Trevino
2010/0095551 A1 4/2010 Gupta et al.
2010/0126041 A1 5/2010 Francis
2010/0139122 A1 6/2010 Zanatta
2010/0170117 A1 7/2010 Kim
2010/0236098 A1 9/2010 Morgan
2011/0099845 A1 5/2011 Miller
2011/0119956 A1 5/2011 Borel et al.
2011/0168313 A1 7/2011 Ma et al.
2011/0247237 A1 10/2011 Jara et al.
2011/0247240 A1 10/2011 Eder et al.
2012/0021167 A1 1/2012 Plant
2012/0023686 A1 2/2012 Huffa et al.
2012/0117826 A1 5/2012 Jarvis
2012/0124861 A1 5/2012 Losani
2012/0124865 A1 5/2012 Opie et al.
2012/0129416 A1 5/2012 Anand et al.
2012/0159810 A1 6/2012 Klassen
2012/0174432 A1 7/2012 Peyton
2012/0181896 A1 7/2012 Kornbluh et al.
2012/0198720 A1 8/2012 Farris et al.
2012/0210607 A1 8/2012 Avar et al.
2012/0233878 A1 9/2012 Hazenberg et al.
2012/0266492 A1 10/2012 Youngs et al.
2012/0272550 A1 11/2012 Parce
2012/0315456 A1 12/2012 Scarpa et al.
2013/0000152 A1 1/2013 Cooper et al.
2013/0071583 A1 3/2013 Evans et al.
2013/0081305 A1 4/2013 Byrne
2013/0104428 A1 5/2013 O'Brien et al.
2013/0160324 A1 6/2013 Peyton et al.
2013/0160328 A1 6/2013 Hatfield et al.
2013/0219636 A1 8/2013 Dojan et al.
2013/0239444 A1 9/2013 Polegato Moretti
2013/0276333 A1 10/2013 Wawrousek et al.
2013/0284732 A1 10/2013 Van Schaftingen
2013/0340288 A1 12/2013 Baker et al.
2014/0053311 A1 2/2014 Nordstrom et al.
2014/0053312 A1 2/2014 Nordstrom et al.
2014/0059734 A1 3/2014 Toronjo
2014/0090271 A1 4/2014 Hoffer et al.
2014/0101816 A1 * 4/2014 Toronjo ..... A41D 31/0011 2/69
2014/0109286 A1 * 4/2014 Blakely ..... A41D 31/02 2/69
2014/0157631 A1 6/2014 Dodd
2014/0165427 A1 6/2014 Molyneux et al.
2014/0173938 A1 6/2014 Beye et al.
2014/0237850 A1 8/2014 Hull
2014/0260281 A1 9/2014 Innes
2015/0040436 A1 2/2015 Clerc et al.
2015/0075033 A1 3/2015 Cross et al.
2015/0075034 A1 3/2015 Cross et al.
2016/0058121 A1 * 3/2016 Langvin ..... A43B 5/06 36/103
2016/0095385 A1 * 4/2016 Nordstrom ..... A43B 13/181 36/29

FOREIGN PATENT DOCUMENTS

GB 2 463 446 A 3/2010
JP 2005-143637 A 6/2005
WO 03/022085 A2 3/2003

(56) References Cited

FOREIGN PATENT DOCUMENTS

| | | | |
|---|---|---|---|
| WO | 2007052054 | A1 | 5/2007 |
| WO | 2012171911 | A1 | 12/2012 |
| WO | 2015041796 | A1 | 3/2015 |

OTHER PUBLICATIONS

Office Action mailed Mar. 26, 2015 in U.S. Appl. No. 14/030,002.
International Search Report and Written Opinion mailed Oct. 14, 2015 in PCT/US2015/038958.
International Search Report and Written Opinion mailed Nov. 17, 2015 in PCT/US2015/040523.

* cited by examiner

SOLE STRUCTURE HAVING AUXETIC STRUCTURES AND SIPES

BACKGROUND

The present embodiments relate generally to articles of footwear, and in particular to articles of footwear with uppers and sole structures.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect, the embodiments provide a sole structure having a midsole component with an inner recessed surface and an outer surface. The midsole component includes a plurality of recessed portions that are arranged in an auxetic configuration in the outer surface. The plurality of recessed portions include a first recessed portion. The first recessed portion is bordered by at least a first sole portion and a second sole portion. The first sole portion and the second sole portion are connected by a junction. The first sole portion has a first elevated portion and the second sole portion has a second elevated portion. The first elevated portion has a first elevated surface. The first elevated surface is located a first distance away from the inner recessed surface. The second elevated portion has a second elevated surface. The second elevated surface is located a second distance away from the inner recessed surface. The junction has a junction surface and the junction surface is located a third distance away from the inner recessed surface. The first distance and the second distance both being larger than the third distance.

In another aspect the embodiments provide a sole structure, that includes a midsole component having an inner recessed surface and an outer surface. The midsole component includes a plurality of recessed portions arranged in an auxetic configuration. The plurality of recessed portions include a first recessed portion and the first recessed portion extends from the outer surface to the inner recessed surface. The first recessed portion is bounded by a first side surface of the midsole component and the first side surface is continuous around the first recessed portion. The first side surface has an outer edge and an inner edge. A total depth of the first recessed portion being defined by a distance from the outer edge to the inner edge of the first side surface. The first side surface includes a first color segment and a second color segment. The first color segment extends a first distance from the inner edge. The second color segment is located adjacent to the first color segment. The first color segment being a different color than the second color segment.

In another aspect the embodiments provide a sole structure includes a midsole component that has an inner surface and an outer surface. The midsole component has a peripheral edge. The midsole component includes a plurality of recessed portions arranged in an auxetic configuration. The plurality of recessed portions are arranged in a central portion of the midsole component. The central portion is spaced from the peripheral edge. A plurality of sipes extend from the peripheral edge toward the plurality of recessed portions. And at least one sipe intersects with at least one recessed portion.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
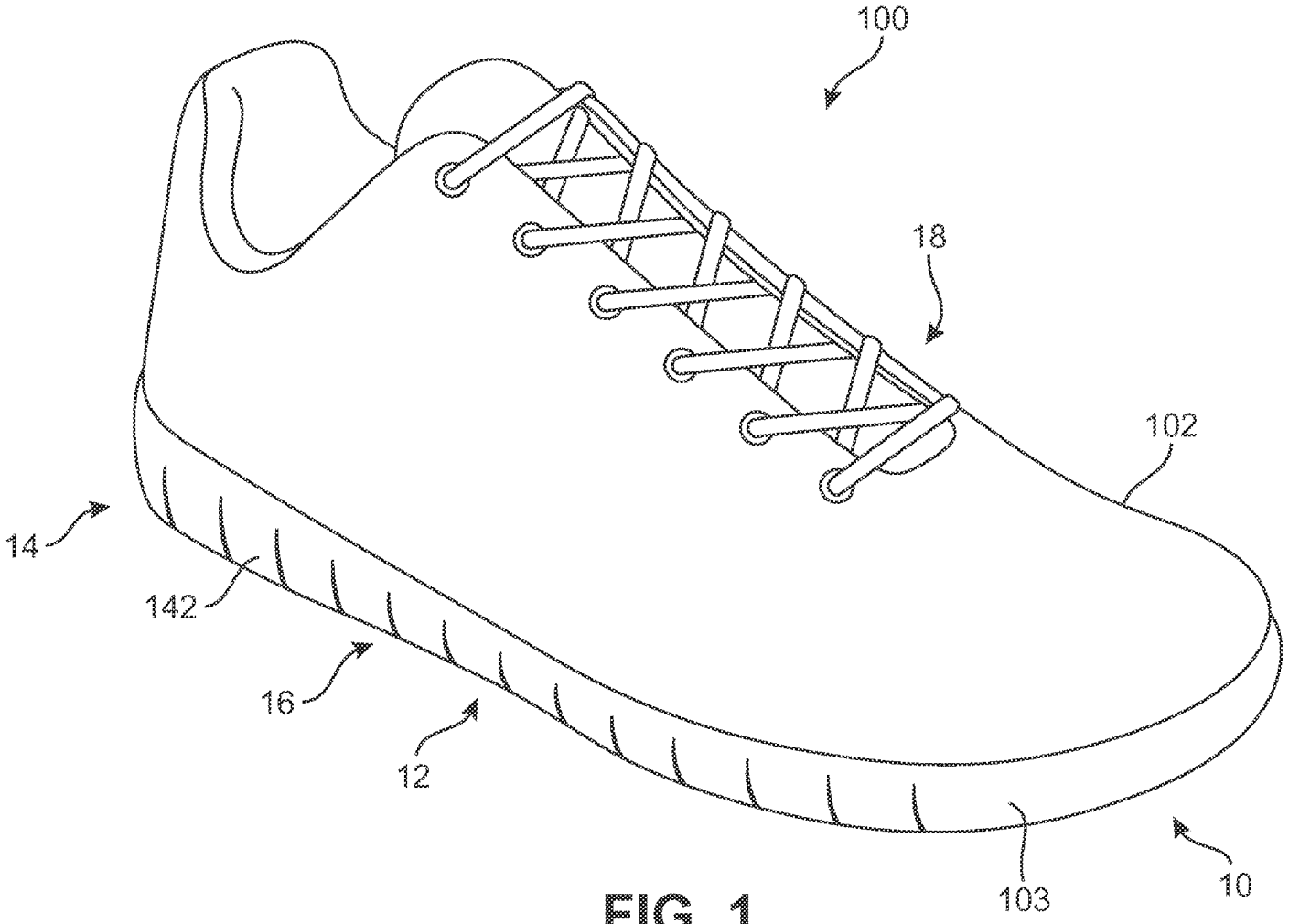
FIG. 1 is an isometric view of an embodiment of an article of footwear.

FIG. 1 is an isometric view of an embodiment of an article of footwear 100. In the exemplary embodiment, article of footwear 100 has the form of an athletic shoe. However, in other embodiments, the provisions discussed herein for article of footwear 100 could be incorporated into various other kinds of footwear including, but not limited to, basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports related footwear, including, but not limited to, slippers, sandals, high-heeled footwear, and loafers.

For purposes of clarity, the following detailed description discusses the features of article of footwear 100, also referred to simply as article 100. However, it will be understood that other embodiments may incorporate a corresponding article of footwear (e.g., a left article of footwear when article 100 is a right article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing subcomponents of an article of footwear (e.g., directions and/or portions of an inner sole component, a midsole component, an outer sole component, an upper, or any other components).

For consistency and convenience, directional adjectives are employed throughout this detailed description corresponding to the illustrated embodiments. The term "longitudinal" as used throughout this detailed description and in the claims refers to a direction oriented along a length of a component (e.g., an upper or sole component). In some cases, a longitudinal direction may be parallel to a longitudinal axis that extends between a forefoot portion and a heel portion of the component. Also, the term "lateral" as used throughout this detailed description and in the claims refers to a direction oriented along a width of a component. In some cases, a lateral direction may be parallel to a lateral axis that extends between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, a vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure, and/or an outer sole structure.

Article 100 may be characterized by a number of different regions or portions. For example, article 100 could include a forefoot portion, a midfoot portion, a heel portion, and an ankle portion. Moreover, components of article 100 could likewise comprise corresponding portions. Referring to FIG. 1, article 100 may be divided into forefoot region 10, midfoot region 12, and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. Article 100 may also include an ankle portion, which may also be referred to as a cuff portion that is associated with the ankle of a user. In addition, article 100 may include lateral side 16 and medial side 18. In particular, lateral side 16 and medial side 18 may be opposing sides of article 100. Furthermore, both lateral side 16 and medial side 18 may extend through forefoot region 10, midfoot region 12, heel region 14, and the ankle portion.

Figure 2:
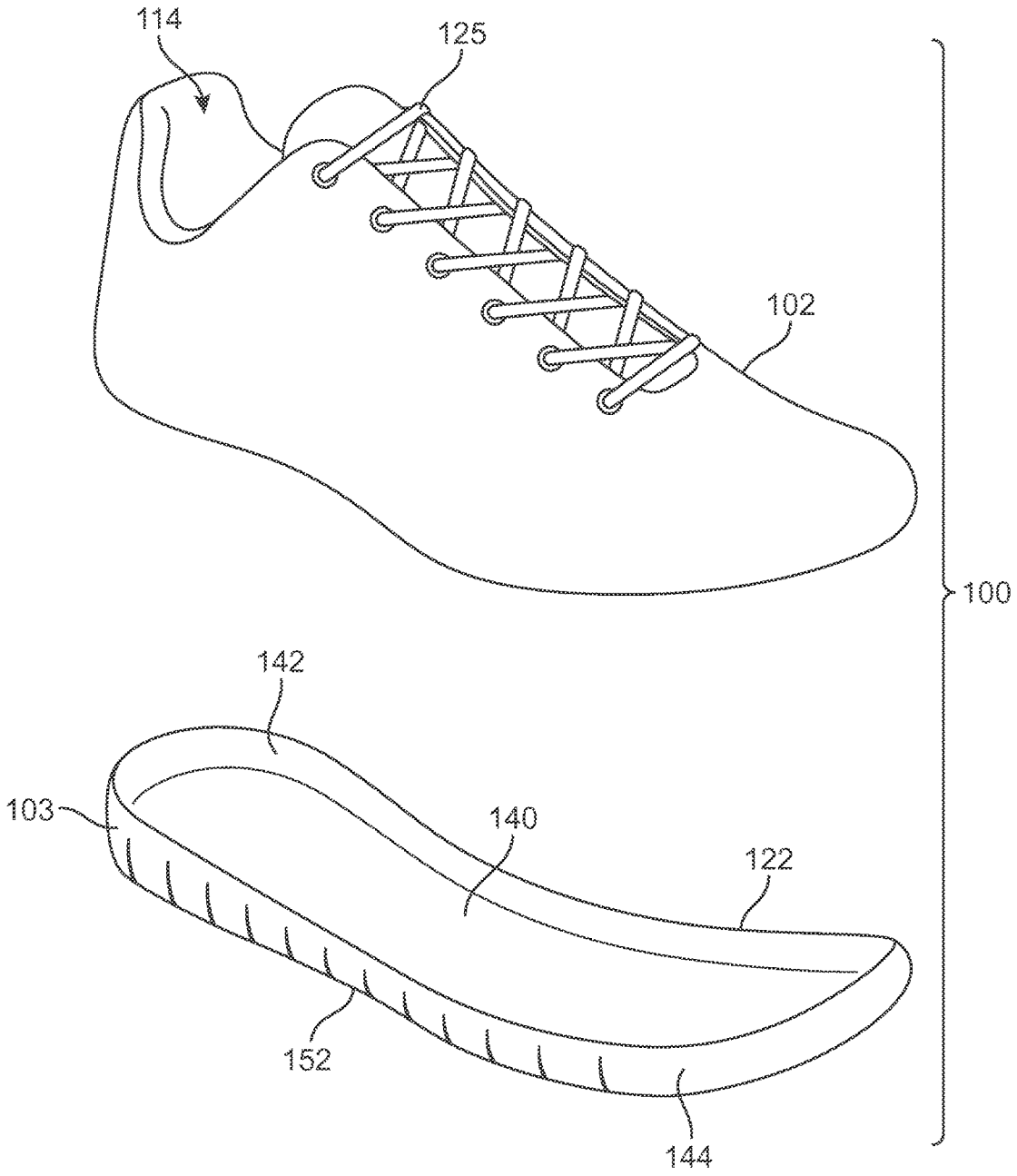
FIG. 2 is an exploded isometric view of an embodiment of article of footwear.

FIG. 2 illustrates an exploded isometric view of an embodiment of article of footwear 100. FIGS. 1 and 2 illustrate various components of article of footwear 100, including an upper 102 and a sole structure 103.

Generally, upper 102 may be any type of upper. In particular, upper 102 may have any design, shape, size, and/or color. For example, in embodiments where article 100 is a basketball shoe, upper 102 could be a high-top upper that is shaped to provide high support on an ankle. In embodiments where article 100 is a running shoe, upper 102 could be a low-top upper.

In some embodiments, upper 102 includes opening 114 that provides entry for the foot into an interior cavity of upper 102. In some embodiments, upper 102 may also include a tongue that provides cushioning and support across the instep of the foot. Some embodiments may include fastening provisions, including, but not limited to, laces, cables, straps, buttons, zippers as well as any other provisions known in the art for fastening articles. In some embodiments, lace 125 may be applied at a fastening region of upper 102.

Some embodiments may include uppers that extend beneath the foot, thereby providing 360-degree coverage at some regions of the foot. However, other embodiments need not include uppers that extend beneath the foot. In other embodiments, for example, an upper could have a lower periphery joined with a strobel, sole structure, and/or sock liner.

An upper could be formed from a variety of different manufacturing techniques, resulting in various kinds of upper structures. For example, in some embodiments, an upper could have a braided construction, a knitted (e.g., warp-knitted) construction, or some other woven construction. In an exemplary embodiment, upper 102 may be a knitted upper.

In some embodiments, sole structure 103 may be configured to provide traction for article 100. In addition to providing traction, sole structure 103 may attenuate ground reaction forces when compressed between the foot and the ground during walking, running, or other ambulatory activities. The configuration of sole structure 103 may vary significantly in different embodiments to include a variety of conventional or non-conventional structures. In some cases, the configuration of sole structure 103 can be configured according to one or more types of ground surfaces on which sole structure 103 may be used. Examples of ground surfaces include, but are not limited to, natural turf, synthetic turf, dirt, hardwood flooring, as well as other surfaces.

Sole structure 103 is secured to upper 102 and extends between the foot and the ground when article 100 is worn. In different embodiments, sole structure 103 may include different components. In some embodiments, sole structure 103 may include midsole component 122 and a plurality of outer sole members. In some cases, one or more of these components may be optional.

Midsole component 122 may be configured to provide cushioning, shock absorption, energy return, support, as well as possibly other provisions. To this end, midsole component 122 may have a geometry that provides structure and support for article 100. Specifically, midsole component 122 may be seen to have upper surface 140 and sidewall portion 142. Sidewall portion 142 may extend around the entire periphery 144 of midsole component 122. As seen in FIG. 1, sidewall portion 142 may partially wrap up the sides of upper 102 to provide increased support along the base of the foot. Upper surface 140 may be generally oriented toward upper 102, while an outer surface 152 may be oriented outwardly.

Figure 3:
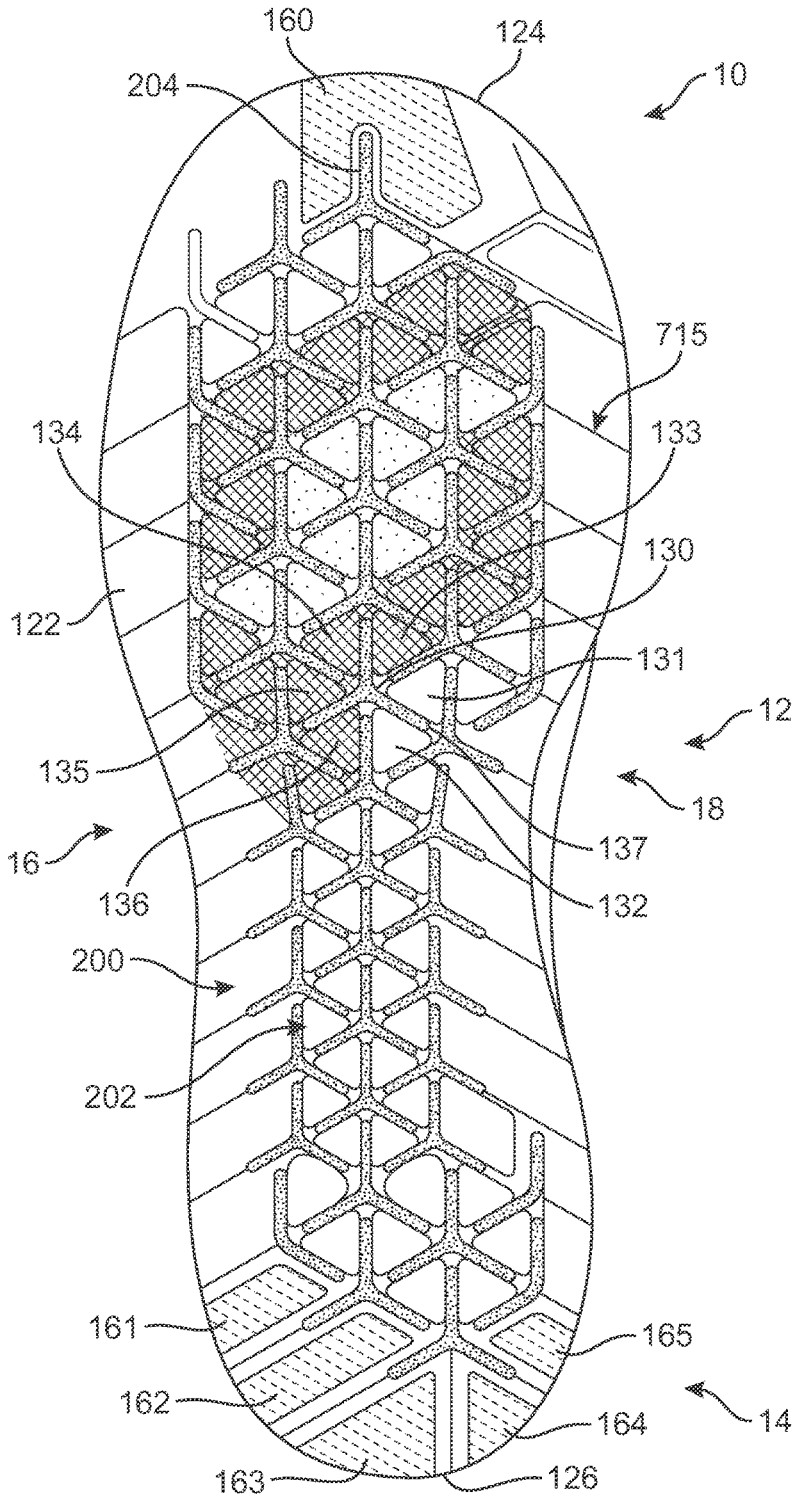
FIG. 3 is a bottom view of an embodiment of an article of footwear.

Referring to FIG. 3, in some embodiments, midsole component 122 may include a plurality of recessed portions 200 that may extend partially through the thickness of midsole component 122 from outer surface 152 toward upper surface 140. In some embodiments, the thickness of the plurality of recessed portions 200 may vary throughout sole structure 103. For example, in some embodiments, the recessed portions located in heel region 14 may be deeper or extend along a larger distance through sole structure 103 than the recessed portions located in forefoot region 10. In other embodiments, the depth of the recessed portions may be consistent throughout sole structure 103.

In different embodiments, midsole component 122 may generally incorporate various provisions associated with midsoles. For example, in one embodiment, a midsole component may be formed from a polymer foam material that attenuates ground reaction forces (i.e., provides cushioning) during walking, running, and other ambulatory activities. In various embodiments, midsole components may also include fluid-filled chambers, plates, moderators, or other elements that further attenuate forces, enhance stability, or influence the motions of the foot, for example.

FIG. 3 illustrates a bottom view of sole structure 103. As seen in FIG. 3, the plurality of outer sole members includes six distinct outer sole members. Specifically, sole structure 103 includes first outer sole member 160, second outer sole member 161, third outer sole member 162, fourth outer sole member 163, fifth outer sole member 164, and sixth outer sole member 165. Although the exemplary embodiment includes six different outer sole members, other embodiments could include any other number of outer sole members. In another embodiment, for example, only a single outer sole member may be present. In still another embodiment, only two outer sole members may be used. In still another embodiment, only three outer sole members could be used. In still other embodiments, seven or more outer sole members could be used.

Generally, an outer sole member may be configured as a ground-contacting member. In some embodiments, an outer sole member could include properties associated with outsoles, such as durability, wear resistance, and increased traction. In other embodiments, an outer sole member could include properties associated with a midsole, including cushioning, strength, and support. In the exemplary embodiment, the plurality of outer sole members may be configured as outsole-like members that enhance traction with a ground surface while maintaining wear resistance.

In different embodiments, the locations of one or more outer sole members could vary. In some embodiments, one or more outer sole members could be disposed in a forefoot portion of a sole structure. In other embodiments, one or more outer sole members could be disposed in a midfoot portion of a sole structure. In still other embodiments, one or more outer sole members could be disposed in a heel portion of a sole structure. In an exemplary embodiment, first outer sole member 160 may be disposed in forefoot region 10 of sole structure 103. More specifically, first outer sole member 160 may be disposed adjacent toe edge 124. In addition, in the exemplary embodiment second outer sole member 161, third outer sole member 162, fourth outer sole member 163, fifth outer sole member 164, and sixth outer sole member 165 may be disposed in heel region 14 of sole structure 103. More specifically, second outer sole member 161 and third outer sole member 162 may be generally disposed on lateral side 16. Fifth outer sole member 164 and sixth outer sole member 165 may be generally disposed on medial side 18. Further, fourth outer sole member 163 may be located between third outer sole member 162 and fifth outer sole member 164. Fourth outer sole member 163 may be disposed along heel edge 126 of sole structure 103. Furthermore, second outer sole member 161, third outer sole member 162, fourth outer sole member 163, fifth outer sole member 164, and sixth outer sole member 165 are spaced apart from one another in heel region 14. This exemplary configuration provides outer sole members at areas of increased ground contact during various lateral and medial cuts, so as to enhance traction during these motions.

The sizes of various outer sole members could vary. In the embodiments, first outer sole member 160 may be the largest outer sole member of the plurality of the outer sole members. Moreover, sixth outer sole member 165 may be substantially smaller than first outer sole member 160. Additionally, second outer sole member 161, third outer sole member 162, fourth outer sole member 163, fifth outer sole member 164, and sixth outer sole member 165 may each individually be smaller that first outer sole member 160. The outer sole members in heel region 14 may, however, have a larger total surface area than the surface area of first outer sole member 160. Individualized control of various areas of heel region 14 may be realized by spacing the outer sole members in heel region 14.

In some embodiments, an inner surface of the outer sole members may be disposed against midsole component 122. The outer surface of the outer sole members may face outwardly and may be a ground-contacting surface.

In different embodiments, the materials and/or physical properties of an outer sole member could vary. In some embodiments, an outer sole member could have a relatively high coefficient of friction when compared to a midsole component. For example, in an exemplary embodiment, first outer sole member 160 may have a first coefficient of friction with a predetermined material (e.g., wood, laminate, asphalt, concrete, etc.) and midsole component 122 may have a second coefficient of friction with the same predetermined material. In some embodiments, the first coefficient of friction is different than the second coefficient of friction. In an exemplary embodiment, the first coefficient of friction is greater than the second coefficient of friction, so that first outer sole member 160 provides increased traction (or grip) with the predetermined material in comparison to midsole component 122. In at least some embodiments, the predetermined material may be associated with a type of ground surface. For example, the predetermined material could be wood associated with wood flooring in basketball courts. In other embodiments, the predetermined material could be laminate material that may also be associated with some kinds of courts. In still other embodiments, the predetermined material could be asphalt. In still other embodiments, the predetermined material could be concrete.

Likewise, in some embodiments, each of the remaining outer sole members may also have higher coefficients of friction (relative to a given ground surface) than midsole component 122. This arrangement may allow a user to brake or make cuts by engaging at least one of the outer sole members with a ground surface. It will be understood that in other embodiments, first outer sole member 160 could have a coefficient of friction equal to or less than the coefficient of friction of midsole component 122.

It may be appreciated that the coefficient of friction may change according to ambient conditions such as temperature, velocity, etc. Moreover, the coefficients of friction could be different for dry versus wet conditions. As used herein, the first coefficient of friction and the second coefficient of friction defined for first outer sole member 160 and midsole component 122, respectively, may be dry coefficients of friction at standard temperatures and pressures.

Increased friction with a ground surface can be achieved by utilizing materials having higher coefficients of friction and/or by providing surface features that enhance grip with the ground. Such features could include tread elements such as ridges, hemispheric protrusions, cylindrical protrusions as well as other kinds of tread elements.

In different embodiments, the densities of an outer sole member and/or a midsole component could vary. In some embodiments, an outer sole member may have a higher density than a midsole component, thereby allowing for increased durability and wear resistance for the outer sole member. In other embodiments, however, the density of the outer sole member could be equal to the density of the midsole component, or could be less than the density of the midsole component.

Outer sole members could be manufactured from a variety of different materials. Exemplary materials include, but are not limited to, rubber (e.g., carbon rubber or blown rubber), polymers, thermoplastics (e.g., thermoplastic polyurethane), as well as possibly other materials. In contrast, midsole components may generally be manufactured from polyurethane, polyurethane foam, other kinds of foams as well as possibly other materials. It will be understood that the type of materials for outer sole members and a midsole component could be selected according to various factors including manufacturing requirements and desired performance characteristics. In an exemplary embodiment, suitable materials for the outer sole members and midsole component 122 could be selected to ensure the outer sole members have a larger coefficient of friction than midsole component 122, especially when these components are in contact with hardwood surfaces, laminate surfaces, asphalt, as well as other surfaces where article of footwear 100 may be most commonly used.

In different embodiments, upper 102 and sole structure 103 could be joined in various ways. In some embodiments, upper 102 could be joined to a strobel using an adhesive or by stitching. In other embodiments, upper 102 could be joined to midsole component 122, for example, along sidewall portion 142. In still other embodiments, upper 102 could be joined with both a strobel and midsole component 122. Moreover, these components may be joined using any methods known in the art for joining sole components with uppers, including various lasting techniques and provisions (e.g., board lasting, slip lasting, etc.). Such bonding or attachment could be accomplished using any known methods for bonding components of articles of footwear, including, but not limited to, adhesives, films, tapes, staples, stitching, or other methods.

The outer sole members may be likewise bonded or otherwise attached to midsole component 122. Such bonding or attachment could be accomplished using any known methods for bonding components of articles of footwear, including, but not limited to, adhesives, films, tapes, staples, stitching, or other methods.

In at least some embodiments, midsole component 122 and the outer sole members could be formed and/or bonded together during a molding process. For example, in some embodiments, upon forming midsole component 122, first outer sole member 160 may be molded within forming midsole component 122.

Embodiments can include provisions to facilitate expansion and/or adaptability of a sole structure during dynamic motions. In some embodiments, a sole structure may be configured with auxetic provisions. In particular, one or more components of the sole structure may be capable of undergoing auxetic motions (e.g., expansion and/or contraction).

Sole structure 103, as shown in FIGS. 1-5 and as described further in detail below, has an auxetic structure or configuration. Sole structures comprising auxetic structures are described in Cross, U.S. Patent Application Publication No. 2015/0075033, published Mar. 19, 2015 and entitled "Auxetic Structures and Footwear with Soles Having Auxetic Structures" (the "Auxetic Structures application"), the entirety of which is hereby incorporated by reference.

Figure 4:
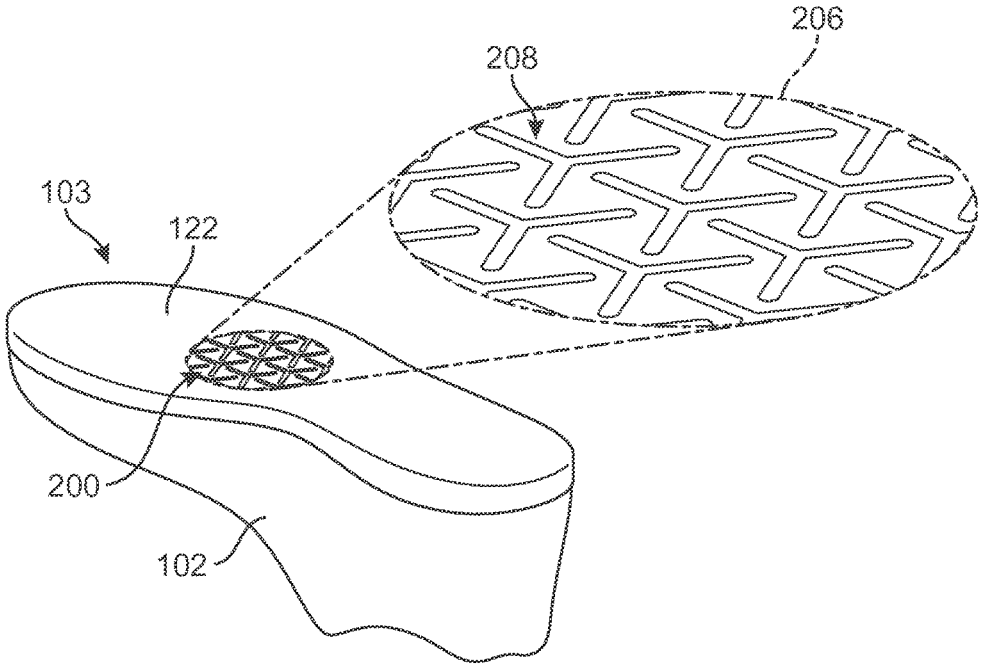
FIG. 4 is a bottom isometric view of an embodiment of a sole structure including an enlarged schematic view of a portion of the sole structure.
Figure 5:
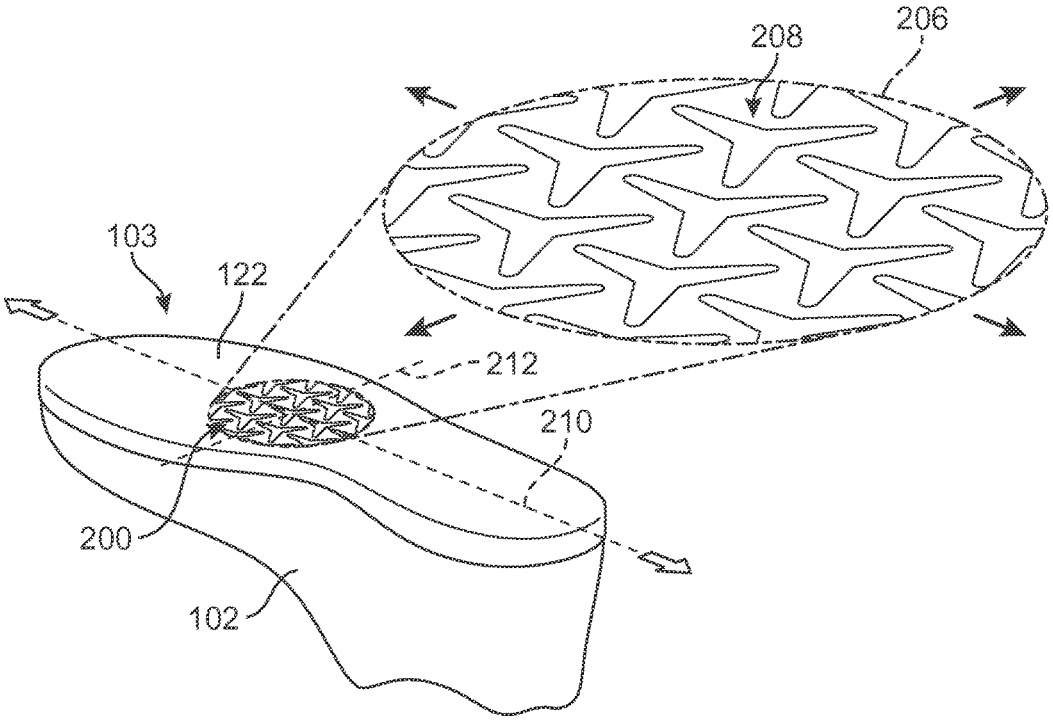
FIG. 5 is a bottom isometric view of an embodiment of a sole structure including an enlarged schematic view of a portion of the sole structure, in which the portion of the sole structure is undergoing auxetic expansion.

As described in the Auxetic Structures application, auxetic materials have a negative Poisson's ratio, such that when they are under tension in a first direction their dimensions increase both in the first direction and in a second direction orthogonal or perpendicular to the first direction. This property of an auxetic material is illustrated in FIGS. 4 and 5.

As seen in FIG. 3, sole structure 103 may include plurality of recessed portions 200. As used herein, the term "recessed portion" refers to any hollowed area or recessed area in a component. In some cases, a recessed portion may be a through hole, in which the recessed portion extends between two opposing surfaces of a component. In other cases, a recessed portion may be a blind-hole, in which the recessed portion may not extend through the entire thickness of the component and may therefore only be open on one side. Moreover, as discussed in further detail below, a component may utilize a combination of through holes and blind-holes. Furthermore, the term "recessed portion" may be used interchangeably in some cases with "aperture" or "hole."

In regions including one or more recessed portions, sole structure 103 may be further associated with a plurality of discrete sole portions 202, or sole portions 202. Specifically, sole portions 202 comprise the portions of sole structure 103 that extend between plurality of recessed portions 200. It may also be seen that plurality of recessed portions 200 extend between sole portions 202. Thus, it may be understood that each recessed portion may be surrounded by a plurality of sole portions, such that the boundary of each recessed portion may be defined by the edges of the sole portions. In some embodiments, some recessed portions may be surrounded by six different sole portions. For example, recessed portion 130 is surrounded by sole portion 131, sole portion 132, sole portion 133, sole portion 134, sole portion 135, and sole portion 136. Moreover, each of sole portion 131, sole portion 132, sole portion 133, sole portion 134, sole portion 135, and sole portion 136 have one edge that bounds a portion of recessed portion 130. In some embodiments, each of the sole portions surrounding a recessed portion may be connected to one another. For example, sole portion 131 and sole portion 132 may be connected to each other by junction 137. Additionally, in some embodiments, sole portion 132 may be connected to sole portion 133 by a junction. In other embodiments, each of the sole portions may be discrete and separate from one another.

In some embodiments, two or more sole portions may be associated with one another. That is, in some embodiments, a plurality of sole portions may include a junction or otherwise be joined to one another. Two or more sole portions that are joined to one another may be referred to as "dynamic portions." Within a dynamic portion, the motion of one sole portion may influence the motion of adjacent sole portions.

As seen in FIG. 3, plurality of recessed portions 200 may extend through a majority of midsole component 122. In some embodiments, plurality of recessed portions 200 may extend through forefoot region 10, midfoot region 12, and heel region 14 of midsole component 122. In other embodiments, plurality of recessed portions 200 may not extend through each of these portions.

In some embodiments, the outer sole members may extend around or adjacent to plurality of recessed portions 200. For example, first outer sole member 160 extends around a portion of recessed portion 204. In other embodiments, one or more outer sole members may extend over a recessed portion. In still further embodiments, a recessed portion may extend through one or more outer sole members.

In different embodiments, the geometry of one or more recessed portions could vary. In the exemplary embodiment, a majority of the plurality of recessed portions 200 may have a tri-star geometry, including three legs or points extending from a common center. Examples of different geometries that could be used for an auxetic sole structure are disclosed in the detailed description. Moreover, embodiments could also utilize any other geometries, such as utilizing sole portions with parallelogram geometries or other polygonal geometries that are arranged in a pattern to provide the sole with an auxetic structure.

The geometry of one or more sole portions could also vary. It may be understood that the geometry of a sole portion may be determined by the geometry of the recessed portions in an auxetic pattern, and vice versa. For example, changing the shape of a sole portion may change the shape of an adjacent recessed portion. In the exemplary embodiment, each sole portion has an approximately triangular geometry. In other embodiments, sole portions may have other shapes including regular and irregular shapes.

In some embodiments, the geometry of the recessed portions may vary throughout the length of sole structure 103. For example, in some embodiments, the size of the recessed portions may be larger in the forefoot region than in the midfoot region or heel region. By varying the size of the recessed portions, different bending characteristics and cutting characteristic may be provided along various areas of sole structure 103.

Additionally, in some embodiments, the shape of the recessed portions may be different along different areas of sole structure 103. For example, in some embodiments, the recessed portion located along the periphery of sole structure 103 may have a different shape than other recessed portions of sole structure 103. In some embodiments, the recessed portions along the periphery may include two legs or points that extend from a common center.

Plurality of recessed portions 200 may be arranged on sole structure 103 in an auxetic pattern, or auxetic configuration. In other words, plurality of recessed portions 200 may be arranged on midsole component 122 and/or the outer sole members in a manner that allows those components to undergo auxetic motions, such as expansion or contraction. An example of auxetic expansion, which occurs as the result of the auxetic configuration of plurality of recessed portions 200, is shown in FIGS. 4 and 5. Initially, in FIG. 4, sole structure 103 is in a non-tensioned state. In this state, plurality of recessed portions 200 have an un-tensioned area. For purposes of illustration, only representative region 206 of midsole component 122 is shown, where representative region 206 includes a subset of recessed portions 208.

As tension is applied across sole structure 103 along an exemplary longitudinal axis 210 (e.g., along the length of sole structure 103) as shown in FIG. 5, sole structure 103 undergoes auxetic expansion. That is, sole structure 103 expands along directions parallel to longitudinal axis 210, as well as along directions parallel to lateral axis 212, which is perpendicular to exemplary longitudinal axis 210. In FIG. 5, the representative region 206 is seen to expand along both longitudinal axis 210 and lateral axis 212 simultaneously, as subset of recessed portions 208 increase in size.

Figure 6:
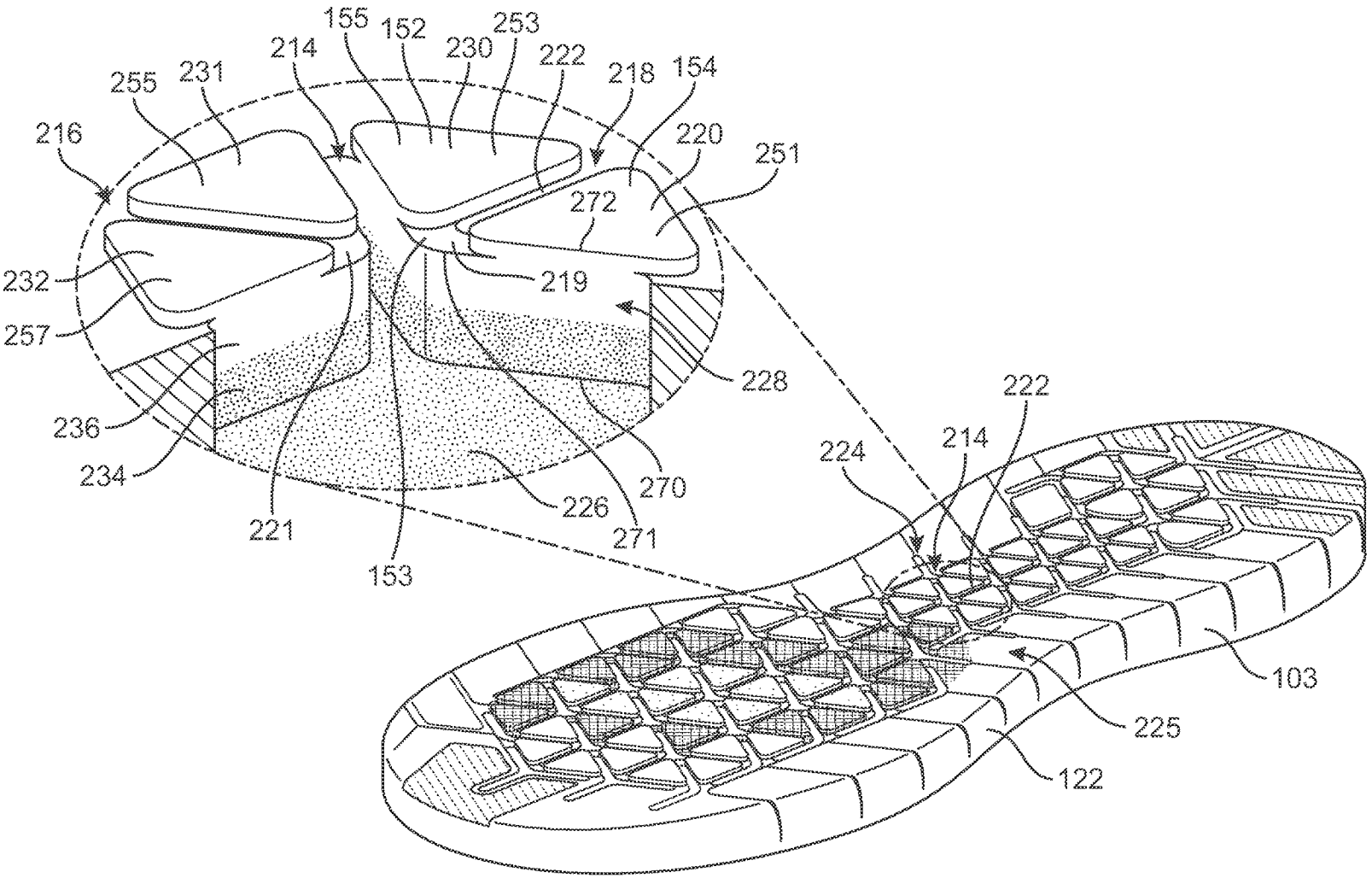
FIG. 6 is a bottom isometric view of an embodiment of a sole structure and an enlarged isometric view of a recessed portion.

FIG. 6 illustrates a bottom isometric view of sole structure 103, including an enlarged cross-sectional view of sole portions surrounding a recessed portion. The four sole portions are oriented around recessed portion 214. As shown, sole portion 251, sole portion 253, sole portion 255, and sole portion 257 border recessed portion 214. Dynamic portion 216 may refer to the structure of sole portion 251, junction 219, and sole portion 253. Additionally, dynamic portion 218 may refer to the structure of sole portion 255, junction 221, and sole portion 257. Dynamic portions and sole portions may be referred to throughout the detailed description.

Figure 7:
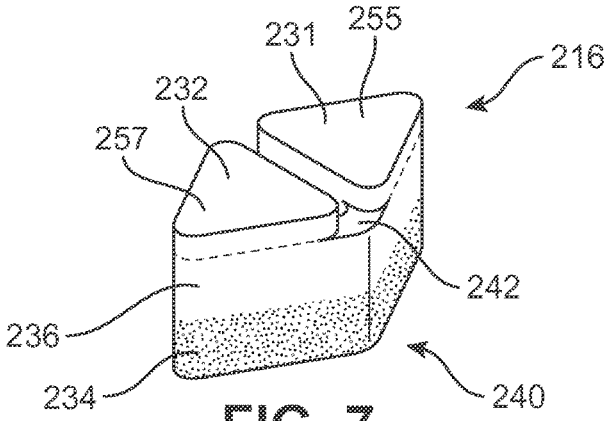
FIG. 7 is an isometric view of an embodiment of a portion of a structure that surrounds a recessed portion.
Figure 8:
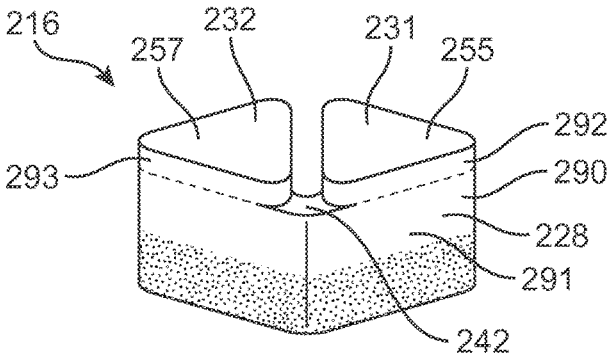
FIG. 8 is an isometric view of an embodiment of a portion of a structure that surrounds a recessed portion.
Figure 9:
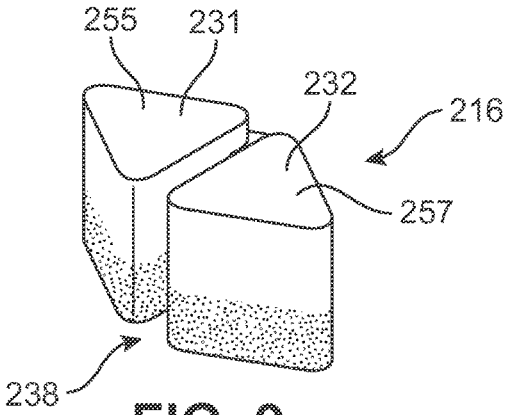
FIG. 9 is an isometric view of an embodiment of a portion of a structure that surrounds a recessed portion.

Although sole portions may be discussed as individual pieces, the sole portions may be formed as a unitary piece with midsole component 122. Further, multiple sole portions may be interconnected or formed from a unitary piece. Sole portions may be numbered for ease of discussion. In some embodiments, the sole portions may not be individual pieces or portions. For example, dynamic portion 216 and dynamic portion 218 may comprise portions of a single or unitary piece of midsole component 122. In other embodiments, multiple individual sole portions may be oriented around a recessed portion. An example of a dynamic portion comprised of two sole portions is shown in FIGS. 7-9. In other embodiments, differently shaped and sized sole portions may be utilized. The shape and size of sole portions along with their relative positioning to recessed portions will be discussed in further detail in the detailed description.

In some embodiments, a sole portion may include a raised or elevated portion. In some embodiments, the elevated portions may be shaped to correspond to the areas of midsole component 122 between each of the recessed portions. For example, first elevated portion 220 is located adjacent to recessed portion 214, recessed portion 222, and recessed portion 224. The shape of first elevated portion 220 corresponds to the space between the recessed portions. For example, a portion of first elevated portion 220 abuts a leg of each of recessed portion 214, recessed portion 222, and recessed portion 224. Therefore, the shape of first elevated portion 220 corresponds to the shape of the space between each of the recessed portions that abut first elevated portion 220.

In some embodiments, a junction may extend between adjacent sole portions. In some embodiments, the junction may extend between each sole portion to form or define a dynamic portion. Junction 219 joins sole portion 251 and sole portion 253. Additionally, multiple junctions extend between various sole portions throughout sole structure 103.

In some embodiments, the junctions may be located at different levels than the elevated portions. That is, in some embodiments, outer surface 152 of the elevated portions may be on a different plane than the outer surface of the junction. As used throughout this detailed description, outer surface 152 refers to the surface of sole structure 103 that is located adjacent to a ground surface or other surface during normal use. Outer surface 152 does not include inner recessed surface 226. For convenience and clarity, the outer surface of the elevated portions and the outer surface of the junctions may be particularly labeled.

In FIG. 6, junction 219 extends between sole portion 251 and sole portion 253. As shown in FIG. 6, for example, outer surface 153 of junction 219 is located at a level that is closer to the foot of a user or the inner surface of sole structure 103 than outer surface 154 of first elevated portion 220 located on sole portion 251 and outer surface 155 of second elevated portion 230 located on sole portion 253.

Further, in some embodiments, the junction may border more than one recessed portion. For example, as shown in FIG. 6, junction 219 borders recessed portion 222 as well as recessed portion 214. As shown, junction 219 borders a central region of recessed portion 214. In contrast, junction 219 also borders a leg or point of recessed portion 222. Therefore, junction 219 may border different areas of different recessed portions.

Additionally, second elevated portion 230, third elevated portion 231, and fourth elevated portion 232 are oriented along recessed portion 214. A fifth raised portion and a sixth raised portion may be oriented along recessed portion 214; however, the fifth raised portion and the sixth raised portion may not be visible in this orientation. In the embodiment as depicted throughout the figures of this detailed description, the elevated portions are formed in a general triangular shape. The triangular shape is due to the shape of the recessed portions. In other embodiments, elevated portions may have different shapes to correspond or extend along portions of differently shaped recessed portions. Additionally, in some figures in the detailed description, the elevated portions may be removed for ease of viewing and description.

As shown throughout this detailed description, many of the recessed portions may be surrounded by dynamic portions that are positioned adjacent to one another and connected to one another. As used throughout this detailed description, the dynamic portions referred to include two sole portions. In other embodiments, dynamic portions may utilize any number of sole portions greater than one sole portion. Additionally, dynamic portions are shown as two sole portions for ease of viewing and discussion.

In some areas of sole structure 103, each of the recessed portions is located adjacent to another recessed portion. In such cases, the sole portions may bound or border a portion of more than one recessed portion. For example, sole portion 251 and sole portion 253 define at least a portion of recessed portion 214, recessed portion 222, recessed portion 224, and recessed portion 225. As such, the sidewall surfaces that extend around sole portion 251 and sole portion 253 may be associated with multiple recessed portions.

In some embodiments, as discussed previously, the shape of a recessed portion may be determined according to the configuration or arrangement of sole portions bounding the recessed portion. As shown in FIG. 6, sole portions are oriented to form a tri-star-shaped opening of recessed portion 214. Recessed portion 214 may include an inner recessed surface 226. Inner recessed surface 226 may be shaped in a tri-star configuration or a different shape that corresponds to the shape of a particular recessed portion. In some embodiments, each of the sole portions that border the recessed portion may abut inner recessed surface 226.

In some embodiments, the sole portions may be separate pieces from inner recessed surface 226. In some embodiments, the sole portions may be glued or otherwise secured to inner recessed surface 226. In other embodiments, inner recessed surface 226 and the sole portions may be formed of unitary construction (e.g., inner recessed surface 226 may be continuous with the sidewalls of one or more sole portions). In some embodiments, the sole portions and inner recessed surface 226 may be molded, stamped, or otherwise formed from a unitary piece.

In some embodiments, the height or vertical dimension of the sidewall surfaces of the sole portions may define the depth of the recessed portions. The sidewall surfaces may extend from the inner recessed surface to an outer surface of sole structure 103. For example, sidewall surface 228 extends from inner surface edge 270 to an outer junction edge 271 and an outer elevated surface edge 272 of sole structure 103. That is, sidewall surface 228 extends from inner recessed surface 226 to outer surface 152. In some embodiments, sidewall surface 228 extends completely around recessed portion 214. In some embodiments, the height of sidewall surface 228 may vary along the perimeter or edge of a recessed portion and thereby define a recessed portion with a varying depth. In other embodiments, the height of sidewall surface 228 may remain constant throughout sole structure 103.

In some embodiments, recessed portions may be associated with one or more colors. In some embodiments, the sidewall surfaces may include various colors. Additionally, in some embodiments, the inner recessed surface may include various colors. As depicted in FIG. 6, sidewall surface 228 is multi-colored. In first area 234 adjacent to inner recessed surface 226, sidewall surface 228 has a first color. In second area 236 adjacent to an upper surface, sidewall surface 228 has a second color. In some embodiments, the first color may be different than the second color. In further embodiments, inner recessed surface 226 may have a third color. In some embodiments, the third color may be the same as the first color. In other embodiments, the third color may be the same as the second color. In still further embodiments, the third color may be different than both the first color and the second color.

As shown in FIGS. 7-9, dynamic portion 216 is multi-colored. In other embodiments, a dynamic portion or a sole portion may have different colors or different layouts along different surfaces. In some embodiments, for example, sole portion 255 may have a different color scheme than sole portion 257 of dynamic portion 216. Additionally, in some embodiments, the surface of first side 238 of dynamic portion 216 may have a different color than the color of second side 240. Additionally, different portions along each side may have a different coloring layout or scheme. Therefore, different portions of a single recessed portion could have different coloring patterns.

As shown in FIGS. 7-9, additionally, the general shape of dynamic portion 216 is shown. As depicted, third elevated portion 231 and fourth elevated portion 232 have a generally triangular shape. Third elevated portion 231 and fourth elevated surface 232 are joined or connected by junction 242. In some embodiments, the outer surface of junction 242 may be located at a lower height than the outer surface of the elevated portions. That is, the outer surface of junction 242 may be located along a different plane than the outer surface of the elevated portions. In some embodiments, the outer surface of junction 242 may be located at a smaller distance away from inner recessed surface 226 than the elevated portions. In other embodiments, the outer surface of junction 242 may be located at a similar height or plane at which the outer surfaces of the elevated portions are located. In other embodiments, the outer surface of junction 242 may be at a different height that is located closer to inner recessed surface 226. By varying the height of the outer surface of junction 242, the flexibility of sole structure 103 may be altered. For example, a larger junction may limit flexibility as an increased amount of material may be used to form sole structure 103. In other embodiments, a thinner junction may allow for sole structure 103 to bend or flex to a greater degree as a thinner junction would use less material than a corresponding larger or thicker junction.

As shown, the elevated portions extend beyond junction 242. In such embodiments, elevated portions may be oriented toward a ground or other surface during use. That is, the elevated portions may act as a ground-engaging surface.

Referring to FIG. 8, a portion of sidewall surface 228 is depicted. As shown previously in FIG. 6, sidewall surface 228 may bound or border recessed portion 214, extending along a tri-star shape. In some embodiments, dynamic portion 216 may include base portion 290. Base portion 290 may include base side surface 291 that extends from sole portion 255 to sole portion 257. Base side surface 291 may form a part of sidewall surface 228. In some embodiments, third elevated portion 231 and fourth elevated portion 232 may include elevated side surfaces. For example, elevated side surface 292 may extend along the side of third elevated portion 231. Additionally, elevated side surface 293 may extend along the side of fourth elevated portion 232. In some embodiments, elevated side surface 293 and elevated side surface 292 may be continuous or coincidental with base side surface 291. In such embodiments, base side surface 291, elevated side surface 292, and elevated side surface 293 may form a generally seamless transition. Further, in such embodiments, a portion of an elevated side surface may bound or border a recessed portion.

Figure 10:
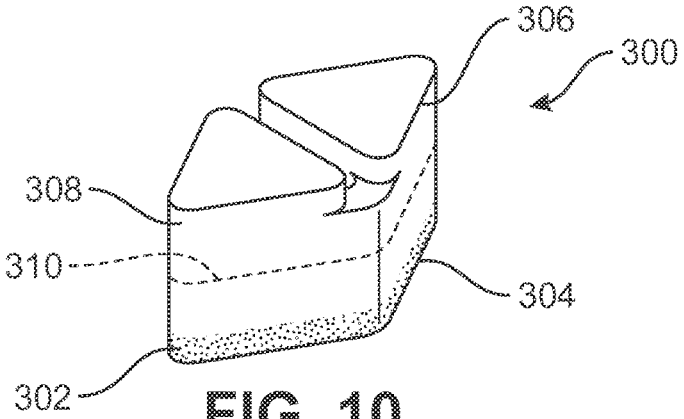
FIG. 10 is an isometric view of an embodiment of a portion of a structure that surrounds a recessed portion.
Figure 11:
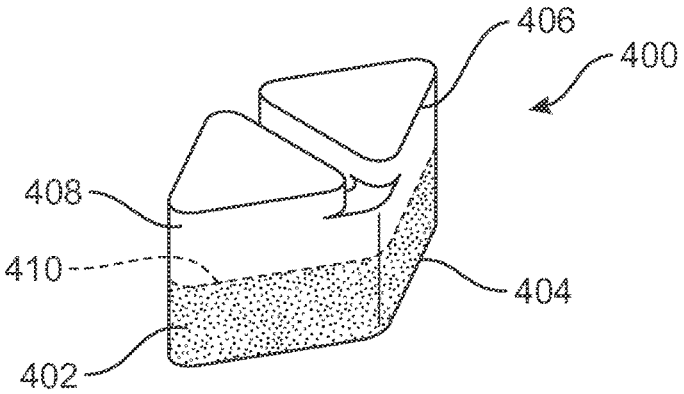
FIG. 11 is an isometric view of an embodiment of a portion of a structure that surrounds a recessed portion.
Figure 12:
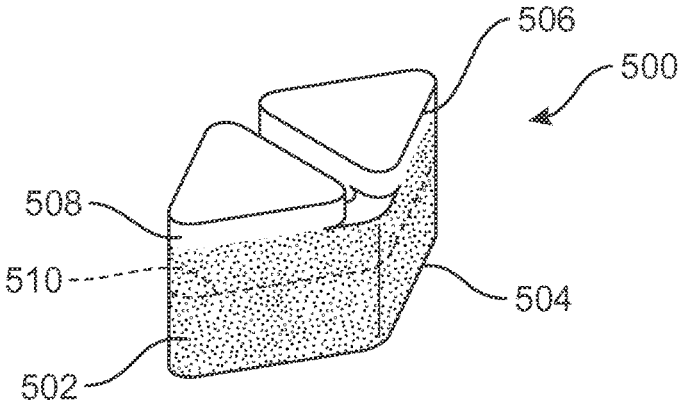
FIG. 12 is an isometric view of an embodiment of a portion of a structure that surrounds a recessed portion.

Referring to FIGS. 10-12, alternate dynamic portions are depicted. Each of the dynamic portions has a different coloring layout. As shown in FIG. 10, dynamic portion 300 has a unique color scheme. Dynamic portion 300 includes first area 302 of a first color. First area 302 extends from inner edge 304 toward outer edge 306. First area 302 extends from inner edge 304 to an area below midline 310. Second area 308 of a second color is located along dynamic portion 300 from first area 302 to outer edge 306.

As shown in FIG. 11, sole portion 400 has a different color scheme. By varying the color scheme, different patterns of display may be utilized throughout the sole structure. Additionally, by varying the color scheme, different colors may be visible depending on the degree to which the sole structure is bent. Sole portion 400 includes first area 402 of a first color. First area 402 extends from inner edge 404 toward outer edge 406. As depicted, first area 402 extends from inner edge 404 to midline 410. Second area 408 of a second color is located along sole portion 400 from first area 402 to outer edge 406.

An alternate color scheme is depicted in sole portion 500 as shown in FIG. 12. As shown, sole portion 500 includes first area 502 of a first color. First area 502 extends from inner edge 504 toward outer edge 506. As depicted, first area 502 extends from inner edge 504 to an area past midline 510. Second area 508 of a second color is located along sole portion 500 from first area 502 to outer edge 506. In other embodiments, the coloring of the first area may extend over the outer surface of a junction. In still further embodiments, the coloring of the first area may extend to the sidewall surfaces of the triangular elevated portions. In still further embodiments, the first color may be located from between the inner edge to the outer edge of a sole portion.

Figure 13:
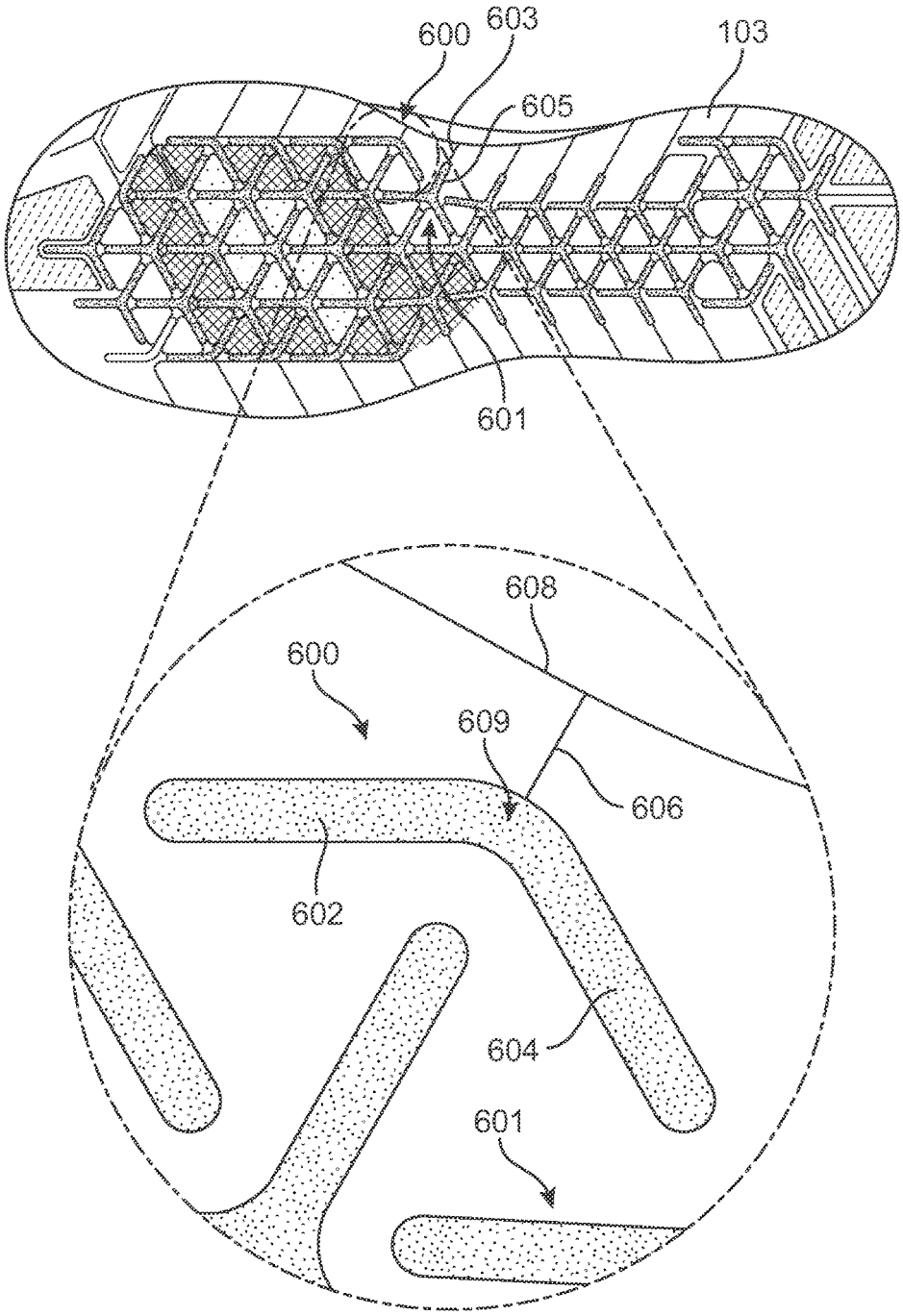
FIG. 13 is a schematic view of an embodiment of a sole structure and an enlarged view of a portion of the sole structure.
Figure 14:
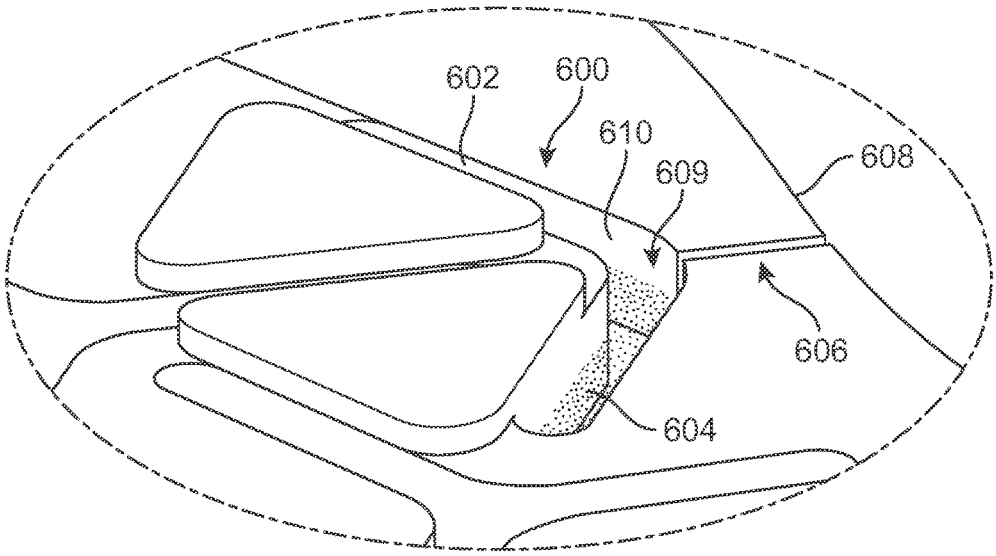
FIG. 14 is an isometric view of an embodiment of a recessed portion of a sole structure.
Figure 15:
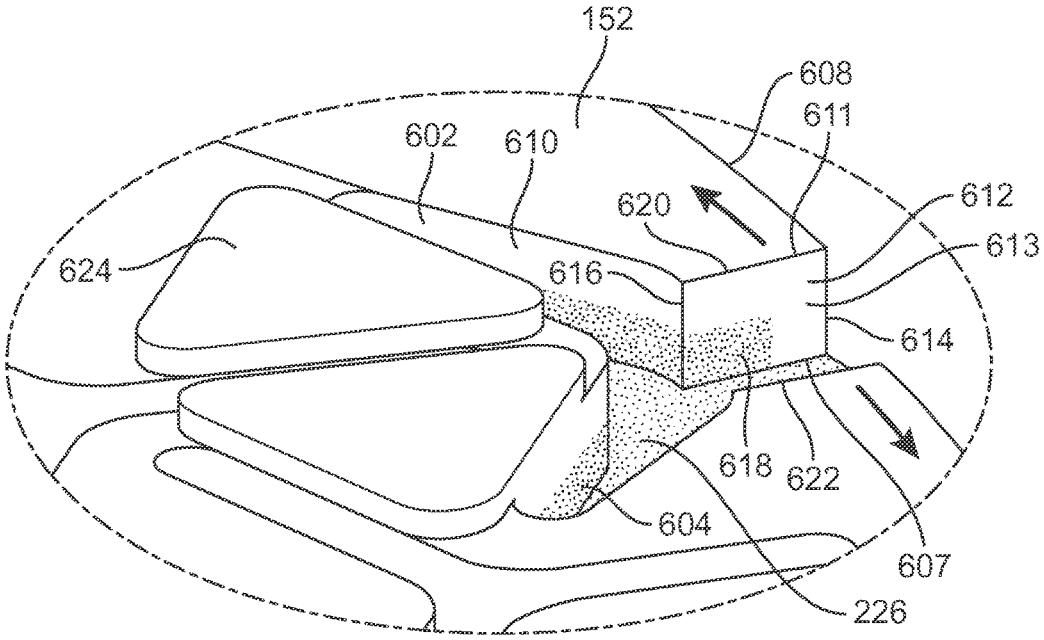
FIG. 15 is an isometric view of an embodiment of a recessed portion of a sole structure subjected to a force.

In some embodiments, recessed portions may abut the edge or side of sole structure 103. In some embodiments, the shape of a recessed portion may be adapted to accommodate variations in location or orientation of the recessed portion along sole structure 103. Referring to FIGS. 13-15, recessed portion 600 includes first leg 602 and second leg 604. Additionally, recessed portion 600 may include sipe 606 that extends from a central portion of recessed portion 600 to peripheral edge 608 of sole structure 103. As used herein, the term "sipe" may refer to a slit, cut, or groove. The shape of recessed portion 600 is in contrast to other recessed portions that are located throughout sole structure 103. For example, recessed portion 601 includes three legs that extend in a tri-star arrangement. Additionally, each of the legs of recessed portion 601 is angled from each other by approximately equal angles. Further, sipe 603 intersects leg 605. In contrast, recessed portion 600 includes first leg 602 and second leg 604. Further, sipe 606 intersects recessed portion 600 at central area 609.

In some embodiments, the different configurations may cause sole structure 103 to react in different manners when subjected to a force at the different locations. For example, sole structure 103 may be able to expand to a greater degree at sipe 603 than at sipe 606. Because recessed portion 601 is a larger void or opening than recessed portion 600, as sole structure 103 is bent at recessed portion 601, the surrounding portions may bend in toward the opening. This movement allows for sole structure 103 to bend a first amount at sipe 603. Additionally, the larger void of recessed portion 601 may provide less resistance to bending because there is less material to resist stretching in the area of recessed portion 601 as compared to recessed portion 600. In contrast, recessed portion 600 is smaller and therefore includes a greater amount of midsole component 122. Sole structure 103 may therefore resist stretch to a greater degree at recessed portion 600 as compared to larger recessed portions intersected by sipes. A sole structure may therefore include variously shaped and sized recessed portions along the peripheral edge to tailor the stretch or bendability of a sole structure.

Referring particularly to recessed portion 600, recessed portion 600 includes a slit or cut that extends from the junction of first leg 602 and second leg 604 to peripheral edge 608 of sole structure 103. In some embodiments, sipe 606 extends along the full thickness of sidewall surface 610. In other embodiments sipe 606 is deeper than the thickness of sidewall surface 610. In still further embodiments, the depth of sipe 606 is less than the thickness of sidewall surface 610. By varying the depth of sipe 606, the amount of stretchability or expansion along peripheral edge 608 of sole structure 103 may be controlled. For example, in some embodiments, a deeper sipe may allow for the edge of sole structure 103 to expand a greater distance than in embodiments that utilized a shallower sipe.

In some embodiments, interior sidewall 612 of sipe 606 may have various color arrangements. In some embodiments, interior sidewall 612 may include a first color that is located adjacent to an interior edge 607 and a second portion located adjacent exterior edge 611. That is, the area of the interior sidewall 612 adjacent to the ground-contacting surface or outer surface 152 may be a different color than the color that is located adjacent inner recessed surface 226 of recessed portion 600.

In some embodiments, the interior sidewall may have various color configurations. For example, the interior sidewall 612 may have first color segment 613 located adjacent peripheral edge 614. In some embodiments, second color segment 618 may extend from central edge 616 toward peripheral edge 614. That is, second color segment 618 may extend along interior sidewall 612 from the location where sipe 606 intersects recessed portion 600 toward peripheral edge 614. In some embodiments, second color segment 618 may extend completely across interior sidewall 612 from central edge 616 to peripheral edge 614. In other embodiments, second color segment 618 may not fully extend across interior sidewall 612.

In some embodiments, first color segment 613 may extend from interior edge 607 toward exterior edge 611. In some embodiments, first color segment 613 may extend fully along interior sidewall 612 from interior edge 607 to exterior edge 611. In other embodiments, first color segment 613 may not fully extend along interior sidewall 612 from interior edge 607 to exterior edge 611. In some embodiments, first color segment 613 may extend from exterior edge 611 toward interior edge 607 along central edge 616. In other embodiments, first color segment 613 may not fully extend from peripheral edge 614 to central edge 616.

In some embodiments, as sole structure 103 is subjected to a tensile force, the peripheral edge of sole structure 103 may expand. As shown in FIG. 15, as first side 620 of sipe 606 is moved away from second side 622 of sipe 606, a greater portion of interior sidewall 612 may be visible. In some embodiments, this action may allow for some of sole portion 624 to be visible from a side view of sole structure 103 thereby exposing the different color arrangements along sole portion 624.

The differences in color between sole portion 624 and interior sidewall 612 may be particularly selected to increase contrast and visibility during use. The color contrast of sole structure 103 may increase the visibility of the wearer in various lighting and environmental conditions. The colored portion may be selected to provide desired visual effects. In addition, the various colors may be utilized during product testing to enhance the visibility of areas of sole structure 103 that are subjected to tensile, compression, bending, or twisting forces. For example, the different color combinations may improve the degree to which areas of sole structure 103 may be captured with still image photography or video, such as high-speed film or other mediums that visually capture performance data during biomechanical or other forms of testing. Additionally, the different colors utilized in sole structure 103 may allow a viewer to determine the gait or any other aspects of how a user walks or runs. Additionally, the aesthetics of the sole may be altered by using the different coloring arrangements or patterns.

Embodiments may include provisions to enhance the flexibility of a sole with recessed portions arranged in an auxetic configuration. In some embodiments, the cuts or sipes along the periphery may allow for the sole structure to bend and twist, and the interior portion may provide stability that limits the amount that a sole structure may twist. By using both layouts, a sole structure may be formed that allows for a predetermined amount of twist and stretch while also providing for control over the sole structure.

In some embodiments, the peripheral edge along sole structure 103 may include plurality of sipes 715 that extend from the peripheral edge to a recessed portion. In some embodiments, each of the plurality of sipes 715 may extend into the recessed portion. In some embodiments, plurality of sipes 715 may partially surround or encompass central portion 716 (see FIG. 16) that includes plurality of recessed portions 200. As best shown in FIG. 3, however, plurality of sipes 715 may not entirely encompass central portion 716. For example, in some embodiments, sipes may not extend from toe edge 124. The embodiment shown in FIG. 3, as an example, may not include sipes extending from toe edge 124 in order to provide a stiffer or less flexible area along toe edge 124. By not including sipes extending from toe edge 124, the peripheral edge of sole structure 103 may be stiff or secure in this area. In other embodiments, however, sipes may extend from toe edge 124.

In some embodiments, by extending each sipe into the recessed portion, the auxetic nature of the recessed portion may be affected. In some embodiments, the siped portion may be able to extend along a longitudinal direction when subjected to force without affecting the width of sole structure 103. Additionally, by extending the sipe into a recessed portion, the attributes of the recessed portions may be coupled with the attributes of a sole structure that includes sipes. For example, the outer periphery of sole structure 103 may be able to bend or stretch without affecting the shape of the interior portion of sole structure 103. Additionally, portions of sole structure 103 may still include an auxetic nature or feel. In this sense, the peripheral portion of sole structure 103 may act or be affected by force in a different manner than the interior portion of sole structure 103 when subjected to a force.

Additionally, by utilizing an auxetic central portion, the amount of material used may be reduced as compared to other sole structures without recessed portions. The auxetic central portion 716 may provide support and traction with limited material. Further, peripheral edge pieces 805 (see FIG. 17) may provide a large surface area to interact with the ground or other surface to increase traction during cutting or lateral movements.

Figure 16:
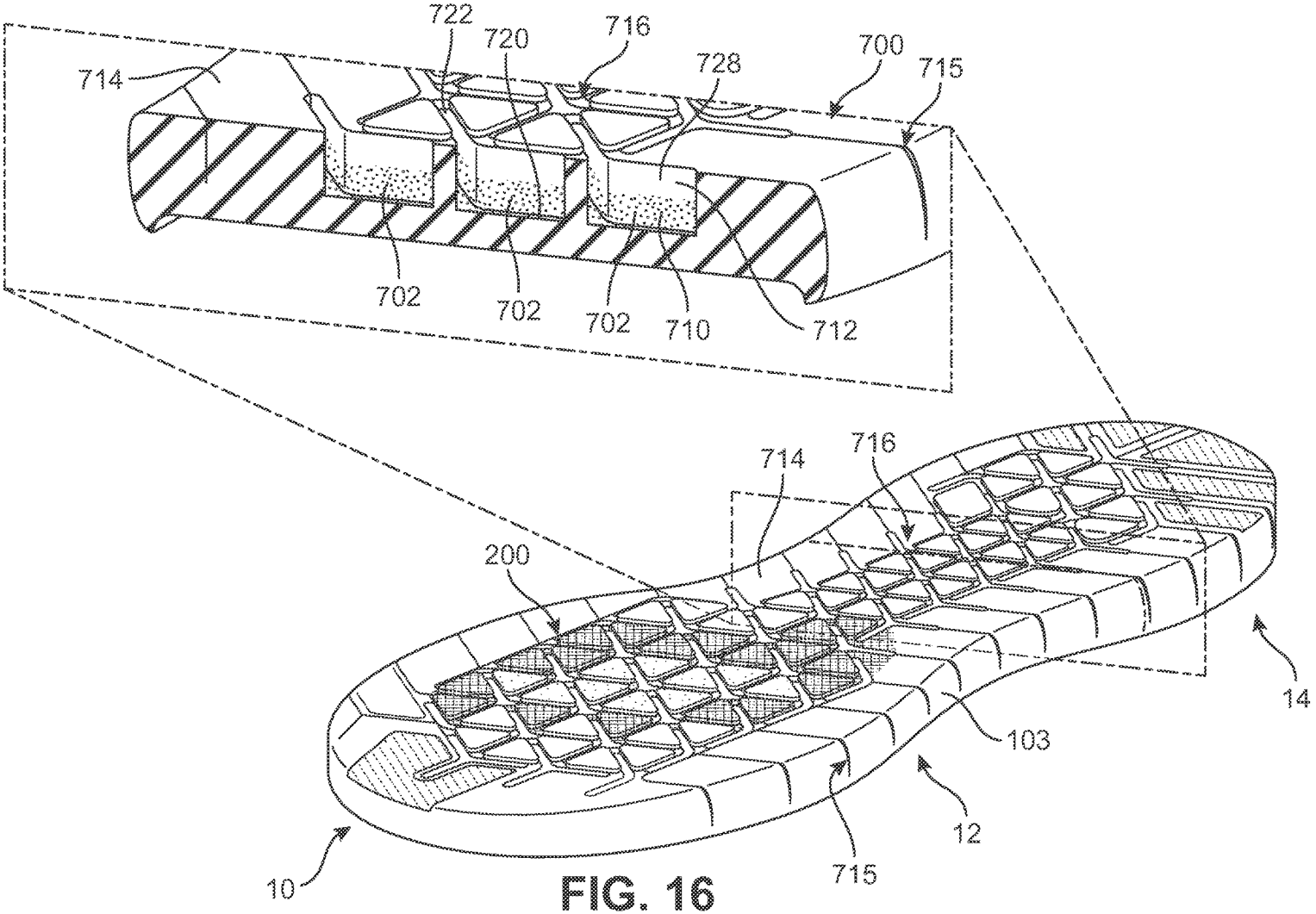
FIG. 16 is an isometric view of an embodiment of a sole structure and an enlarged cutaway isometric view of a portion of the sole structure.
Figure 17:
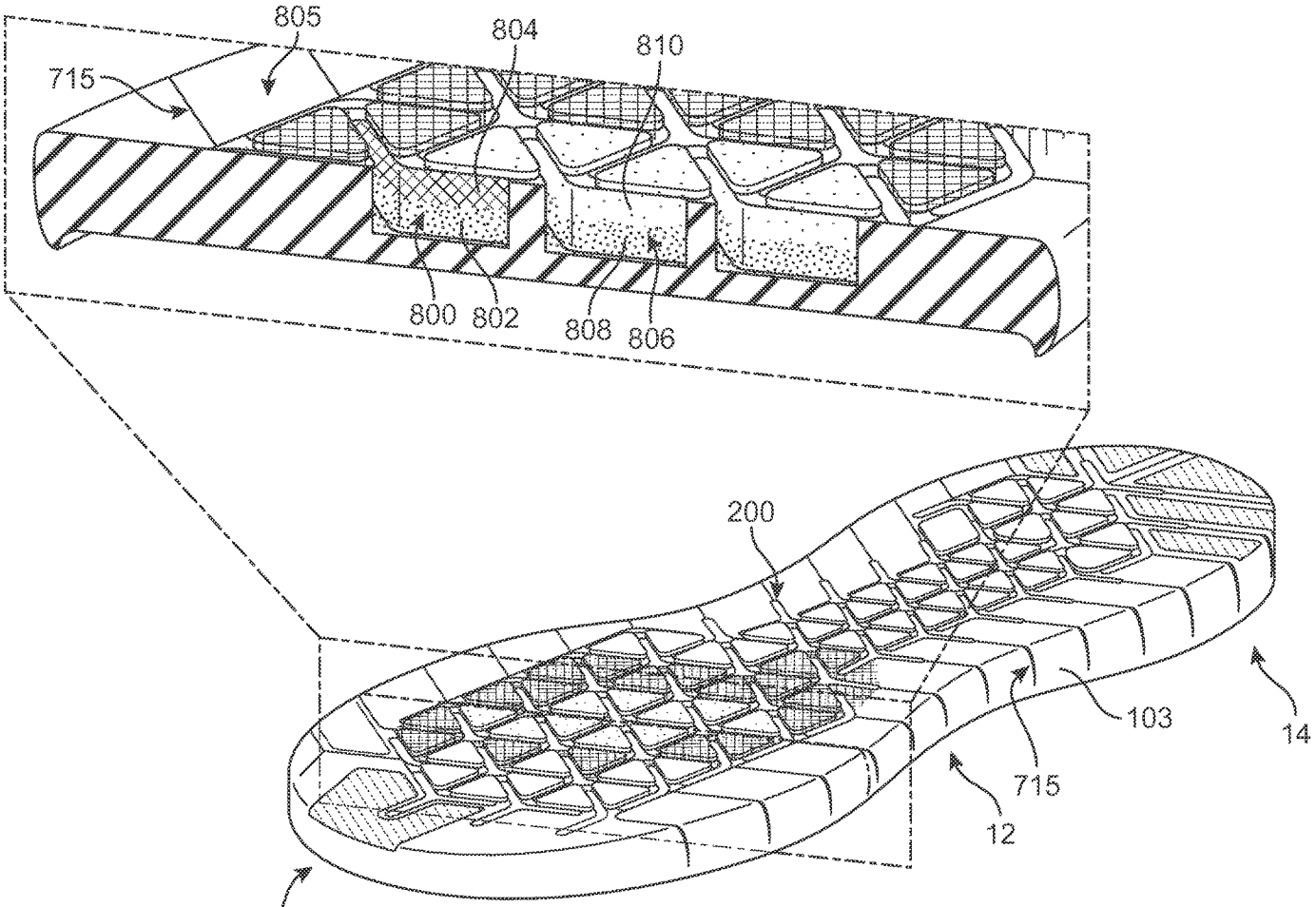
FIG. 17 is an isometric view of an embodiment of a sole structure and an enlarged cutaway isometric view of a portion of the sole structure.

Referring to FIGS. 16 and 17, the color scheme of sole structure 103 may be different in different areas of sole structure 103. For example, in some embodiments, the color scheme of forefoot region 10 may be different than the color scheme of heel region 14. In some embodiments, different colors may be used in different regions for various purposes including aesthetic appeal, contrast for viewing, or to coordinate the sole structure with a certain camera or the like such that the movement of the article may be readily ascertainable during the use of sole structure 103.

Referring to FIG. 16, an isometric cut portion through heel region 14 is shown. Portion 700 is shown that cuts through a portion of three recessed portions. As shown, first color portion 702 extends along sidewall surface 728 that extends around the recessed portions.

In some embodiments, as discussed previously, a color may extend along a portion of sidewall surfaces. As shown in FIG. 16, first color segment 710 of sidewall surface 728 includes a different color than second color segment 712 of sidewall surface 728.

Additionally, in some embodiments, a portion of peripheral edge piece 714 may have a different color arrangement than the color or the interior portion of sole structure 103. For example, in some embodiments, the peripheral edge may be white. In some embodiments, as peripheral edge piece 714 extends toward central portion 716, the color of peripheral edge piece 714 may be altered. For example, in some embodiments, peripheral edge piece 714 may have a white cross section. In other embodiments, a different color may be utilized. In some embodiments, the inner recessed surface may also be different than various areas of the recessed portions. For example, in some embodiments, inner recessed surface 720 of recessed portion 722 may be orange while a sidewall portion of recessed portion 722 may be white. In different embodiments, various combinations of colors and orientations may be utilized.

Referring particularly to FIG. 17, multiple colors may be utilized in particular areas of sole structure 103. As shown in FIG. 17, forefoot region 10 of sole structure 103 utilizes multiple colors throughout the width of sole structure 103. For example, recessed portion 800 includes first color portion 802 that is a first color, for example, orange. Additionally, second color portion 804 is a different color, for example, blue. In some embodiments, first color portion 802 may match the color of second color portion 804. Additionally, in some embodiments, the color of second color portion 804 may extend along elevated portions along sole structure 103. Additionally, a third color may extend along the periphery of sole structure 103. For example, peripheral edge pieces 805 of sole structure 103 may be white.

In some embodiments, another color may be located in recessed portion 806 that is located adjacent to recessed portion 800. For example, in some embodiments, third color portion 808 of recessed portion 806 may be the same color as first color portion 802 of recessed portion 800. Fourth color portion of recessed portion 806 may be a fourth color, for example, teal. In some embodiments, the color arrangement throughout the recessed portions may be different. By orienting the colors in specific patterns, different designs may be used throughout sole structure 103 that may assist in identifying how certain portions of sole structure 103 act when subjected to various forces.

Figure 18:
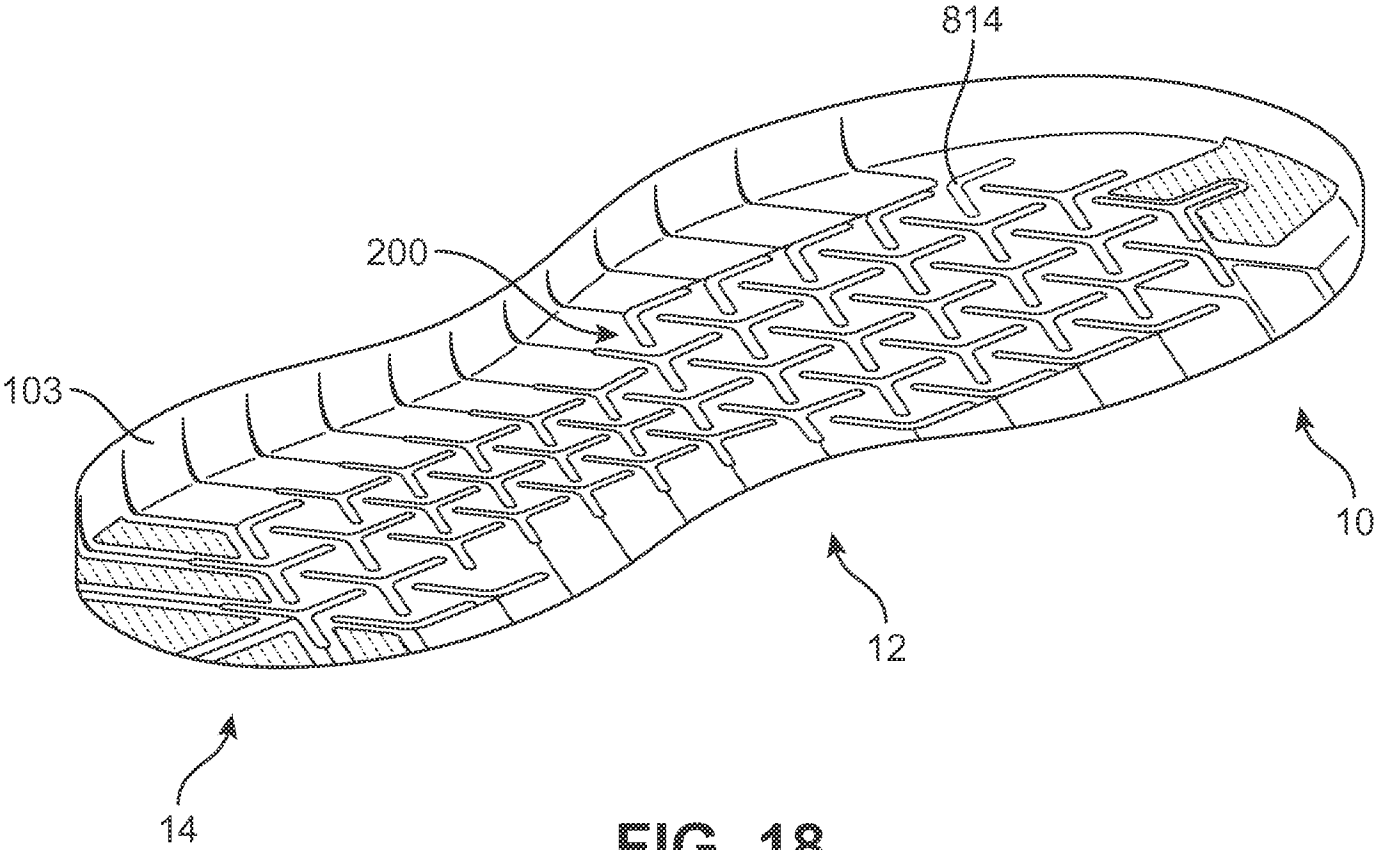
FIGS. 18-19 illustrate an embodiment of a sole structure before and while a compressive force is applied.
Figure 19:
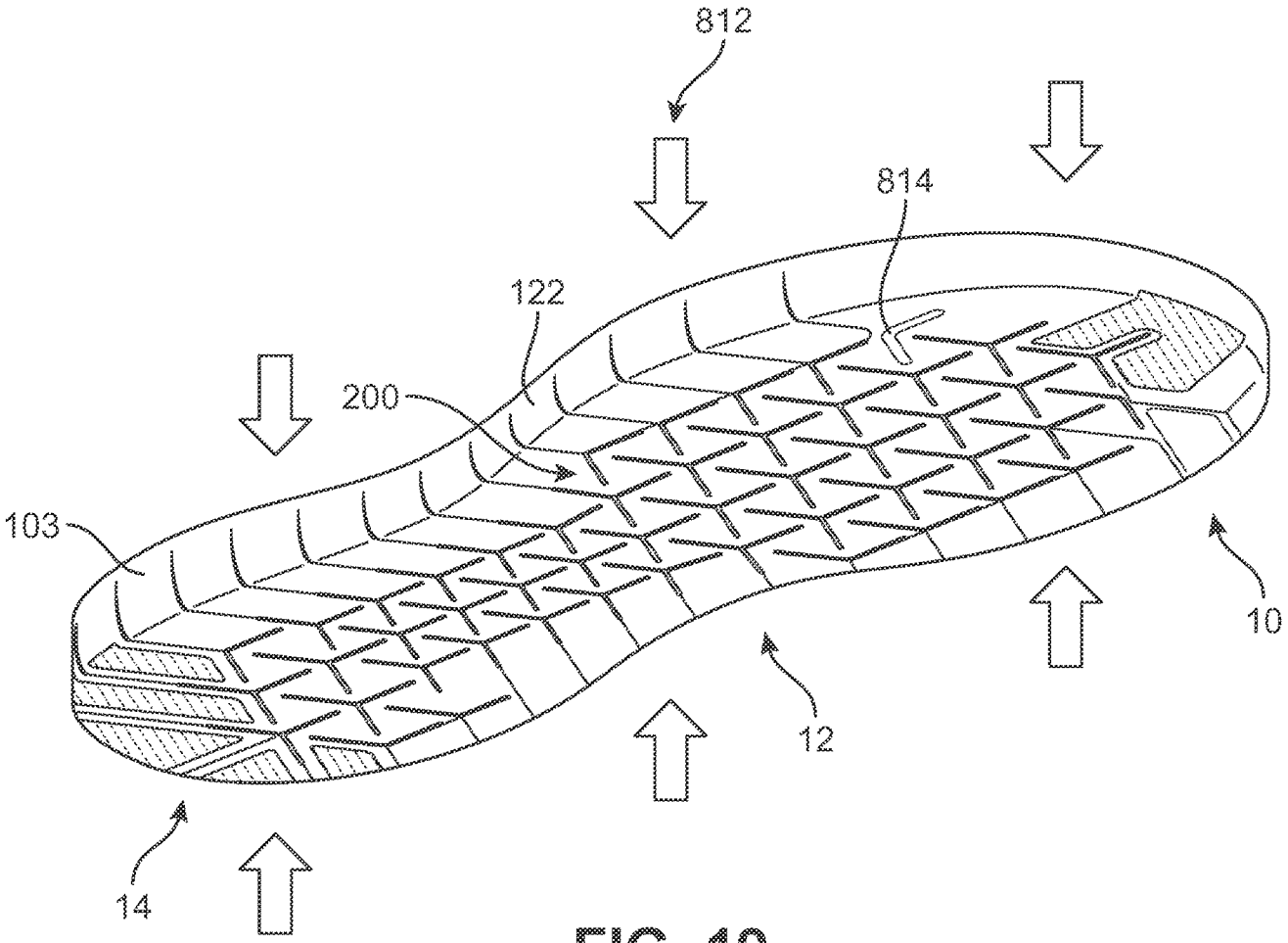

FIGS. 18 and 19 illustrate bottom isometric views of another embodiment of sole structure 103. Specifically, FIG. 18 illustrates a bottom isometric view of sole structure 103 in an uncompressed state, while FIG. 19 illustrates a bottom isometric view of sole structure 103 in a compressed state. Specifically, FIG. 19 shows sole structure 103 deforming under vertically oriented compression forces 812 (i.e., forces generally perpendicular to the sole surface, or to the longitudinal and lateral directions of the sole). As with previous embodiments, sole structure 103 includes midsole component 122 and a plurality of outer sole members.

In the embodiment of FIGS. 18 and 19, plurality of recessed portions 200 are shown in compressed and in uncompressed states. In some embodiments, compressing a sole structure with recessed portions arranged in an auxetic configuration can act to close the recessed portions of the sole structure as the sole portions around the recessed portions expand under compression. As seen, for example, in FIG. 19, the opening size or cross-sectional area of plurality of recessed portions 200 decreases during the application of vertically oriented compression forces 812. In some cases, some recessed portions may completely close while other recessed portions may only partially close. For example, depression 814 may not compress as much as other recessed portions in sole structure 103. Depression 814 may not be the same depth as the other recessed portions and therefore may not experience the auxetic effect to as great an extent as the other recessed portions.

Figure 20:
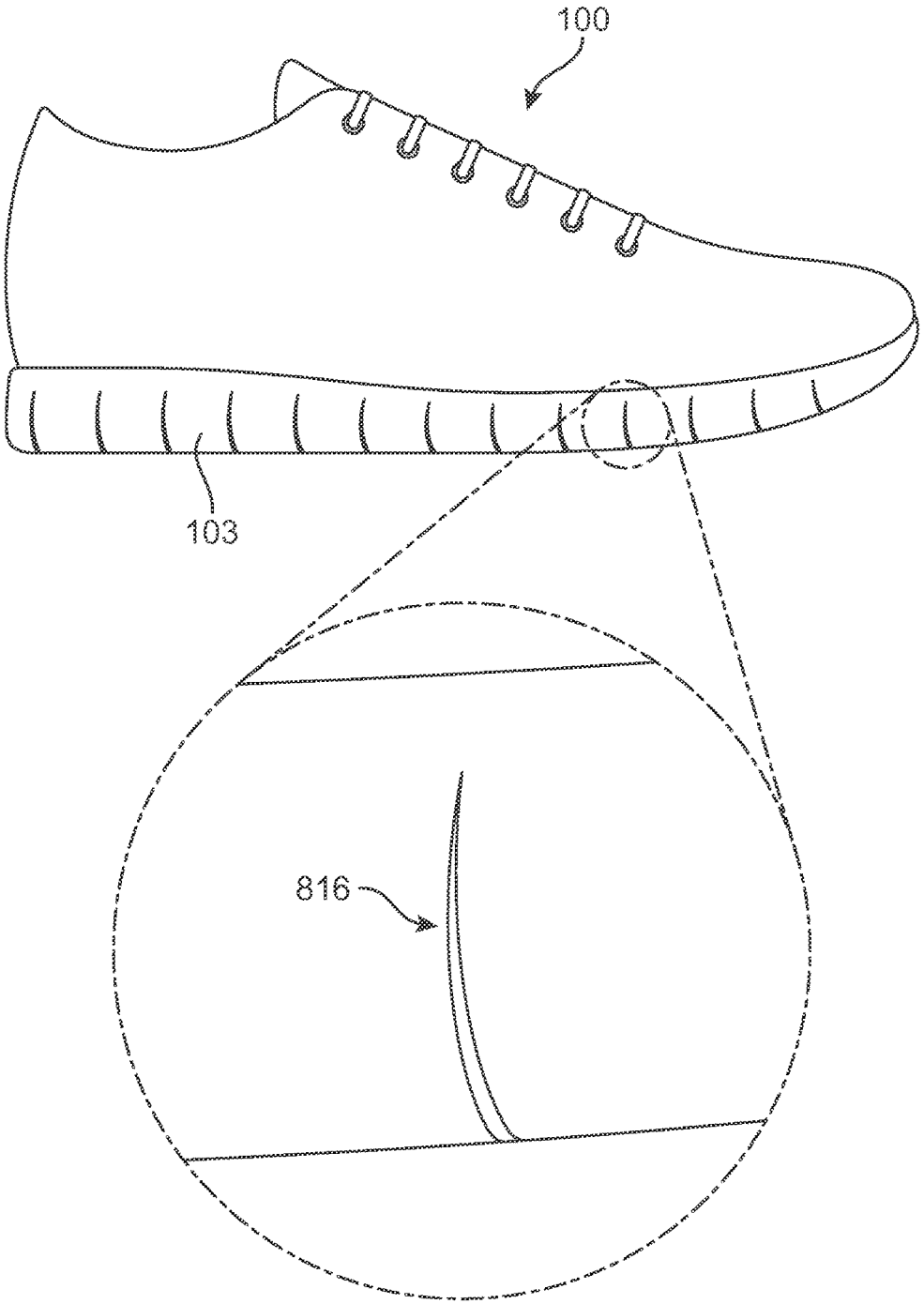
FIG. 20 is a side view of an embodiment of an article and an enlarged view of a slit along the sole structure.
Figure 21:
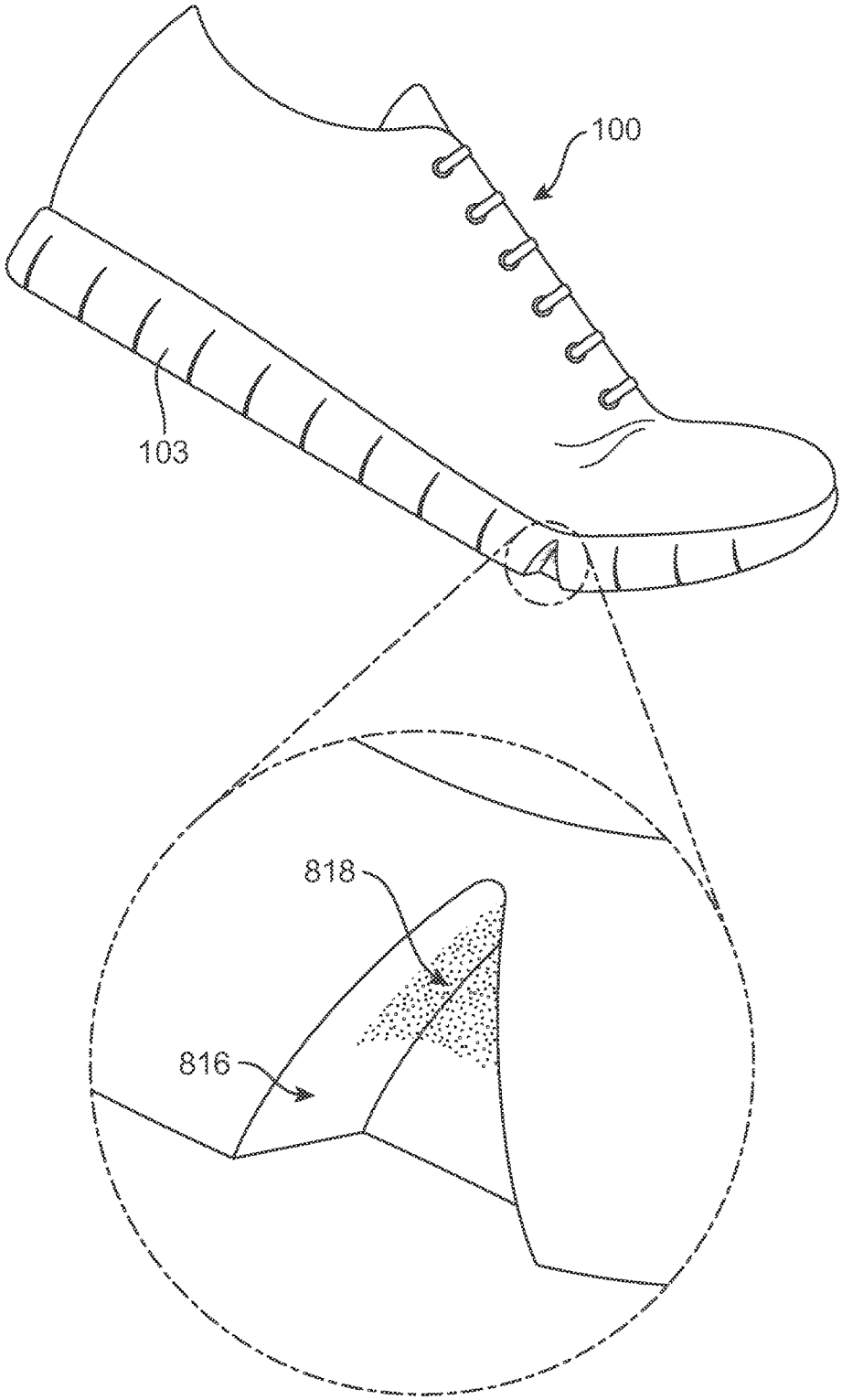
FIG. 21 is a side view of an embodiment of an article and an enlarged view of an expanded slit along the sole structure.

Referring to FIGS. 20 and 21, a side view of article 100 is shown in a relaxed state, and when subjected to a force. In FIG. 21, article 100 is shown in a bent formation that may be a typical formation when used by a wearer. In some embodiments, when viewed from a side view, sole structure 103 may not expose an interior surface. That is, in some embodiments, the sidewall surfaces of recessed portions may not be visible from a side view.

In some embodiments, the exposed side of sole structure 103 may be uniform in color. In other embodiments, the side of sole structure 103 may have different colors along the side of sole structure 103. As shown in FIG. 20, sole structure 103 is formed of a single color with no reveals to the interior portion of sole structure 103. Additionally, as shown in the configuration of FIG. 20, sipe 816 is in a closed or relaxed state. In this state, sipe 816 does not experience a large quantity of longitudinal force. Therefore, the edges of sipe 816 do not extend away from one another in a relaxed state and therefore may hide the interior sidewall surfaces of the recessed portions of sole structure 103.

Referring to FIG. 21, article 100 is shown in a bent position. In some embodiments, as sole structure 103 is bent, a sipe may expand or stretch, in a similar manner as depicted in FIG. 14. In some embodiments, as sipe 816 is expanded, a portion of the interior sidewall surfaces of sole structure 103 may be visible from a side view. In some embodiments, colored portion 818 or contrasting portion of the interior sidewall surfaces may be visible. In such embodiments, the contrast between the exterior side surface coloring and the interior region sidewall surface may increase visibility of a particular section or region of sole structure 103 during use. This contrast may allow for a camera or other visual-capturing device to be able to readily ascertain where various portions of sole structure 103 are located during use for studying or research. Further, the contrast may also increase the ease at which various apertures may expand or contract during use in various conditions and with various configurations.

Figure 22:
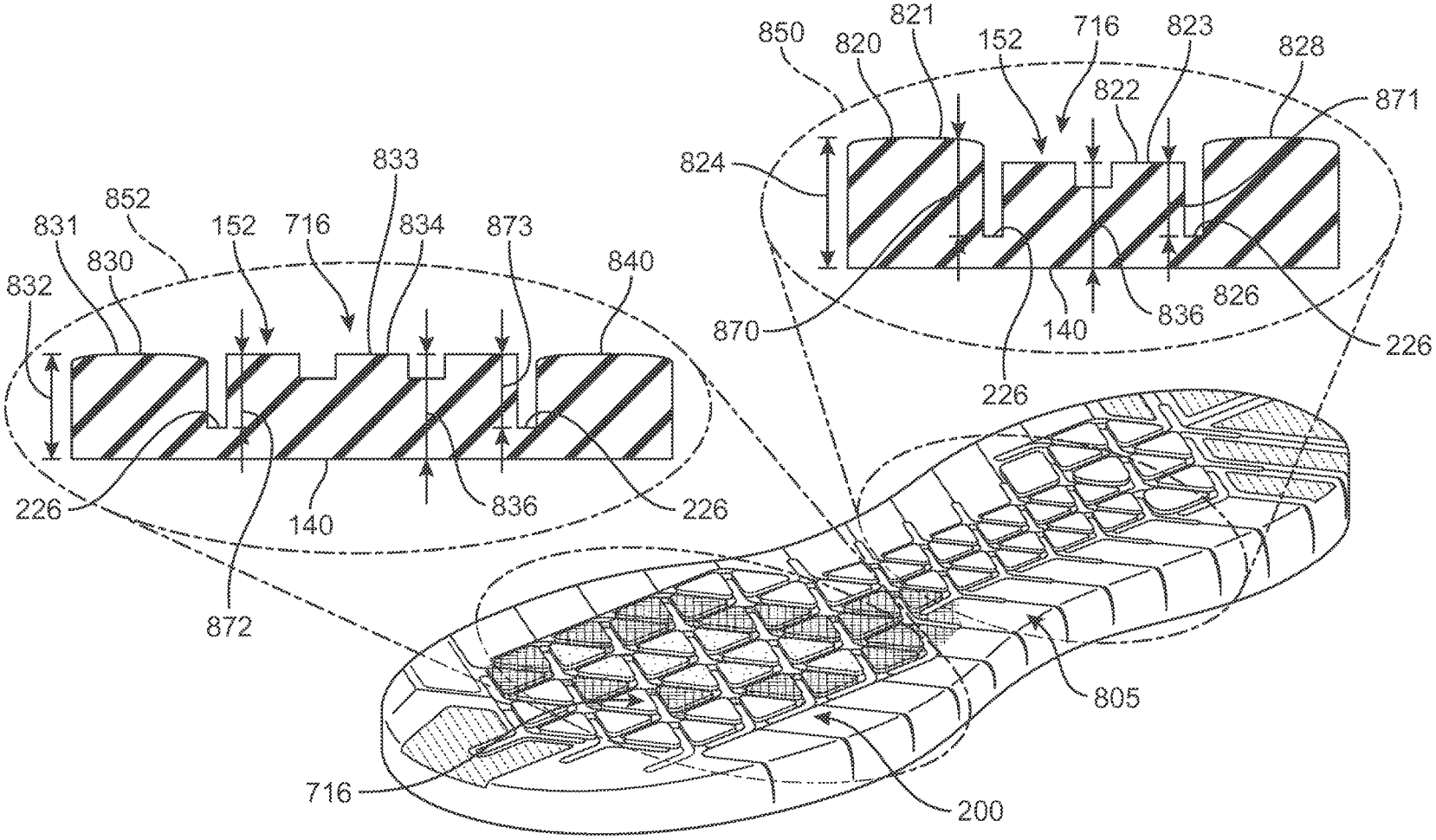
FIG. 22 is an isometric view of an embodiment of a sole structure and enlarged cross-section views along different areas of the sole structure.

Referring to FIG. 22, various cross sections of sole structure 103 are shown. In some embodiments, central portion 716 of sole structure 103 may include plurality of recessed portions 200 that extend throughout central portion 716. As discussed previously, plurality of recessed portions 200 may be bordered by sole portions that include elevated portions. In other embodiments, some portions of central portion 716 may not include elevated portions. For example, in some embodiments, a portion of central portion 716 may not include an auxetic shape or recessed portion. In such areas of sole structure 103, an elevated portion may not be present.

In some embodiments, an elevated portion may be located adjacent to a peripheral edge piece. In some embodiments, peripheral edge pieces 805 may surround central portion 716. In some embodiments, the height of the peripheral edge pieces may be greater than the absolute height of an elevated portion. Referring to enlarged cross-section 850 for example, the distance from upper surface 140 of sole structure 103 to outer surface 821 of peripheral edge piece 820 may be greater than the distance from upper surface 140 of sole structure 103 to outer surface 823 of elevated portion 822. That is, distance 824 may be larger than distance 826. In some embodiments, the distance from an inner recessed surface to an outer surface may be different between peripheral edge pieces and the elevated portions. For example, distance 870 between inner recessed surface 226 and outer surface 821 may be greater than distance 871 between inner recessed surface 226 and outer surface 823. Additionally, in some embodiments, the peripheral edge pieces may be larger around heel region 14. Therefore, as shown, peripheral edge piece 828 may also be larger than the portions of sole structure 103 within central portion 716. In other embodiments, the outer surfaces of peripheral edge pieces 805 may be the same distance away from inner recessed surface 226 along heel region 14.

In embodiments in which distance 870 is larger than distance 871, peripheral edge pieces 805 may be oriented to contact a ground surface before elevated portions of central portion 716 during normal use of sole structure 103. In some embodiments, orienting peripheral edge pieces 805 to contact the ground before central portion 716 may cause sole structure 103 to contact the ground in a particular manner. As sole structure 103 contacts the ground, the peripheral edge pieces may contact the ground first. As the user steps, the central portion of sole structure 103 may then contact the ground. This gap or distance between the outer surfaces of the peripheral edge pieces and the outer surfaces of the elevated portions may provide additional cushion or support in the areas of the sole structure that include this arrangement. By orienting the peripheral edge pieces to contact the ground first, some of the force from contacting the ground may be redistributed or absorbed before the rest of the weight of the user extends into the central portion of sole structure 103. Therefore, the peripheral edge pieces may assist in providing support and cushioning to a wear during use of sole structure 103.

In other areas of sole structure 103, the outer surfaces or ground-contacting surfaces of peripheral edge pieces 805 of sole structure 103 may be located along approximately the same plane as the outer surfaces or ground-contacting surfaces of the elevated portions. That is, in some embodiments, the ground-contacting surfaces of the peripheral edge pieces and the ground-contacting surfaces of the elevated portions may contact the ground or other surface at approximately the same time during use by a wearer.

In some embodiments, orienting the ground-contacting surface of the peripheral edges along the same plane as the elevated portions may assist in providing feedback to a user. Referring to enlarged portion 852, outer surface 831 of peripheral edge piece 830 is located a distance 832 away from upper surface 140 of sole structure 103. Additionally, outer surface 831 is located a distance 872 away from inner recessed surface 226. Outer surface 833 of elevated portion 834 is located a distance 836 away from upper surface 140 of sole structure 103. Additionally, outer surface 833 is located a distance 873 away from inner recessed surface 226. In some embodiments, distance 836 and distance 832 may be approximately the same. In some embodiments, distances 872 and distance 873 may be approximately the same. Additionally, peripheral edge piece 840 may also be approximately the same size as peripheral edge piece 830. Therefore, central portion 716 of forefoot region 10 may be circumscribed by peripheral edge pieces of approximately the same height. In some embodiments, the orientation of the peripheral edges and the elevated portions at the same height may allow for a user to have quick feedback to actions as well as feedback regarding the condition of the surface that the ground-contacting surface contacts by engaging a large percentage of the surface area of sole structure 103 with the ground as quickly as possible.

In some embodiments, the different levels of peripheral edges and elevated portions may be located throughout sole structure 103. For example, in some embodiments, the ground-contacting surface of peripheral edge pieces 805 may extend beyond the ground-contacting surface of the elevated portions in a heel region. Additionally, in the same sole structure, the ground-contacting surface of the peripheral edge pieces and the ground-contacting surface of the elevated portions may be located along the same plane. The location and orientation of the ground-contacting surfaces may be altered in different areas of the sole structure to particularize the comfort and feel of the sole structure. For example, heel region 14 may include greater cushioning, while forefoot region 10 may require more control for cutting or other motions. Therefore, heel region 14 may include a peripheral edge piece that includes a ground-contacting surface that extends beyond the surface of the elevated portions while other areas of sole structure 103 may have different configurations.

Other embodiments of the various sole structures disclosed in the present application may utilize any of the features, provisions, components, functionalities and/or materials that are disclosed in U.S. patent application Ser. No. 14/826,879, filed Aug. 14, 2015 (published as U.S. Patent Publication Number 2017/0042288), titled "Sole Structure Including Sipes," the entirety of which is herein incorporated by reference. Further, other embodiments of the sole structures disclosed in the present application may utilize any of the features, provisions, components, functionalities and/or materials that are disclosed in U.S. patent application Ser. No. 14/826,936, filed Aug. 14, 2015 (published as U.S. Patent Publication Number 2017/0042285), titled "Sole Structures with Regionally Applied Auxetic Openings and Siping," the entirety of which is herein incorporated by reference.

Furthermore, any of the embodiments of the present application could incorporate any of the features, provisions, components, functionalities and/or materials disclosed in any of the following U.S. Applications: U.S. patent application Ser. No. 14/643,121, filed Mar. 10, 2015 (published as U.S. Patent Publication Number 2015/0245686), titled "Sole Structure with Holes Arranged in Auxetic Configuration," the entirety of which is herein incorporated by reference; U.S. patent application Ser. No. 14/643,161, filed Mar. 10, 2015 (published as U.S. Patent Publication Number 2015/0237957), titled "Multi-Component Sole Structure Having an Auxetic Configuration" the entirety of which is herein incorporated by reference; and U.S. patent application Ser. No. 14/643,089, filed Mar. 10, 2015 (published as U.S. Patent Publication Number 2015/0237958), titled "Midsole Component and Outer sole Members with Auxetic Structure" the entirety of which is herein incorporated by reference.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A sole structure, comprising:

a midsole component having an inner recessed surface and an outer surface;

the midsole component including a plurality of recessed portions arranged in an auxetic configuration in the outer surface;

the plurality of recessed portions including a first recessed portion;

the first recessed portion being bordered by at least a first sole portion and a second sole portion;

the first sole portion and the second sole portion being connected by a junction;

the first sole portion having a first elevated portion;

the second sole portion having a second elevated portion;

the first elevated portion having a first elevated surface;

the first elevated surface being located a first distance away from the inner recessed surface;

the second elevated portion having a second elevated surface;

the second elevated surface being located a second distance away from the inner recessed surface;

the junction having a junction surface;

the junction surface being located a third distance away from the inner recessed surface;

wherein the first distance and the second distance are both larger than the third distance.

2. The sole structure of claim 1, wherein the first sole portion has a first sidewall surface, the first sidewall surface bordering a portion of the first recessed portion.

3. The sole structure of claim 2, wherein the first elevated portion has a first elevated sidewall surface, at least a portion of the first elevated sidewall surface partially defining the first recessed portion.

4. The sole structure of claim 3, wherein the first elevated sidewall surface is coincident with the first sidewall surface.

5. The sole structure of claim 3, wherein the sole structure further comprises a second recessed portion and a third recessed portion, wherein the first elevated sidewall surface borders at least a portion of both the second recessed portion and the third recessed portion.

6. The sole structure of claim 1, wherein the first sole portion is of unitary construction with the midsole component.

7. The sole structure of claim 1, wherein the first elevated portion has a triangular shape.

8. The sole structure of claim 1, wherein the first recessed portion has a first leg, a second leg, and a third leg.

9. A sole structure, comprising:

a midsole component having an inner recessed surface and an outer surface;

the midsole component including a plurality of recessed portions arranged in an auxetic configuration;

the plurality of recessed portions including a first recessed portion;

the first recessed portion extending from the outer surface to the inner recessed surface;

the first recessed portion being bounded by a first side surface of the midsole component, the first side surface being continuous around the first recessed portion;

the first side surface having an outer edge and an inner edge;

a total depth of the first recessed portion being defined by a distance from the outer edge to the inner edge of the first side surface;

the first side surface including a first color segment and a second color segment;

the first color segment extending a first distance from the inner edge;

the second color segment being located adjacent to the first color segment;

wherein the first color segment is a different color than the second color segment.

10. The sole structure of claim 9, wherein the second color segment extends from the outer edge toward the inner edge.

11. The sole structure of claim 9, wherein the inner edge abuts the inner recessed surface, the inner recessed surface being the same color as the first color segment.

12. The sole structure of claim 9, wherein the second color segment extends a second distance from the outer edge, wherein the first distance is greater than the second distance.

13. The sole structure of claim 9, wherein the second color segment extends a second distance from the outer edge, wherein the first distance is less than the second distance.

14. The sole structure of claim 9, wherein the second color segment extends a second distance from the outer edge, wherein the first distance is substantially the same as the second distance.

15. The sole structure of claim 9, wherein the plurality of recessed portions further includes a second recessed portion;

the second recessed portion being located adjacent to the first recessed portion;

the second recessed portion being bounded by a second side surface;

the second side surface including a third color segment;

wherein the third color segment is a different color than the first color segment and the second color segment.

16. A sole structure, comprising:

a midsole component having an inner surface and an outer surface;

the midsole component having a peripheral edge;

the midsole component including a plurality of recessed portions arranged in an auxetic configuration;

the plurality of recessed portions arranged in a central portion of the midsole component, the central portion being spaced from the peripheral edge;

a plurality of sipes extending from the peripheral edge toward the plurality of recessed portions;

wherein at least one sipe intersects with at least one recessed portion.

17. The sole structure of claim 16, wherein the plurality of sipes extend through a plurality of peripheral edge pieces, the plurality of peripheral edge pieces extending along the periphery of the midsole component.

18. The sole structure of claim 17, wherein a first recessed portion is located adjacent to a first peripheral edge piece, the first recessed portion including a first leg, a second leg, and a central area that connects the first leg and the second leg, wherein a first sipe extends from the peripheral edge and intersects with the central area of the first recessed portion.

19. The sole structure of claim 17, wherein:

a first recessed portion of the plurality of recessed portions is located in a heel region of the midsole component;

wherein a first peripheral edge piece of the midsole component is located adjacent to the first recessed portion;

wherein the first recessed portion includes a first elevated portion;

wherein a first elevated outer surface of the first elevated portion is located at a first distance away from the inner surface of the midsole component;

a first peripheral outer surface of the first peripheral edge piece being located a second distance away from the inner surface of the midsole component;

wherein the second distance is greater than the first distance.

20. The sole structure of claim 17, wherein a first recessed portion of the plurality of recessed portions is located in a forefoot region of the midsole component, the first recessed portion including a first elevated portion, a first elevated outer surface of the first elevated portion being located at a first distance away from the inner surface of the midsole component;

wherein a first peripheral edge piece of the midsole component is located adjacent to the first recessed portion, a first peripheral outer surface of the first peripheral edge piece being located a second distance away from the inner surface of the midsole component;

wherein the second distance is substantially the same as the first distance.

21. The sole structure of claim 16, wherein the plurality of recessed portions includes a first recessed portion;

the first recessed portion of the midsole component including a first sidewall surface;

the first sidewall surface extending a first distance from an inner edge of the midsole component to an outer edge of the midsole component;

a first sipe of the plurality of sipes intersecting the first recessed portion;

the first sipe having a depth;

wherein the depth of the first sipe is substantially equal to the first distance.

* * * * *